US006447099B2

(12) United States Patent
Silverbrook

(10) Patent No.: US 6,447,099 B2
(45) Date of Patent: Sep. 10, 2002

(54) INK JET MECHANISM WITH THERMOELASTIC BEND ACTUATOR HAVING CONDUCTIVE AND RESISTIVE BEAMS

(75) Inventor: Kia Silverbrook, Balmain (AU)

(73) Assignee: Silverbrook Research Pty LTD, Balmain (AU)

( * ) Notice: Subject to any disclaimer, the term of this patent is extended or adjusted under 35 U.S.C. 154(b) by 0 days.

(21) Appl. No.: 09/798,135

(22) Filed: Mar. 2, 2001

Related U.S. Application Data

(63) Continuation-in-part of application No. 09/112,802, filed on Jul. 10, 1998, now Pat. No. 6,213,589.

(30) Foreign Application Priority Data

Jul. 15, 1997 (AU) ..... PO7991
Jul. 15, 1997 (AU) ..... PO8040

(51) Int. Cl.[7] ..... B41J 2/04
(52) U.S. Cl. ..... 347/54
(58) Field of Search ..... 347/54, 151, 120, 347/141, 154, 103, 123, 111, 159, 127, 128, 131, 125, 158; 399/271, 290, 292, 293, 294, 295

(56) References Cited

U.S. PATENT DOCUMENTS

| | | | |
|---|---|---|---|
| 4,812,792 | A | 3/1989 | Leibowitz |
| 5,459,501 | A | 10/1995 | Lee et al. |
| 5,726,693 | A | 3/1998 | Sharma et al. |
| 5,812,159 | A | 9/1998 | Anagnostopoulos et al. |
| 5,883,650 | A | 3/1999 | Figueredo et al. |

*Primary Examiner*—Raquel Yvette Gordon

(57) ABSTRACT

An ink jet printer uses a planar thermoelastic bend actuator to eject ink from a nozzle chamber. The thermal actuator includes a lower planar surface constructed from a highly conductive material such as a semiconductor metal layer interconnected to an upper planar surface constructed from an electrically resistive material such as Indium Tin Oxide (ITO), such that, upon passing a current between the planar surfaces, the thermal actuator is caused to bend towards an ink ejection port so as to thereby cause ejection of ink from the ink ejection port. The actuator is attached to a substrate and further includes a stiff paddle portion which increases the degree of bending of the actuator near the point where it is attached to the substrate. The surfaces are further coated with a passivation material as required.

16 Claims, 35 Drawing Sheets

INK JET MECHANISM WITH THERMOELASTIC BEND ACTUATOR HAVING CONDUCTIVE AND RESISTIVE BEAMS

This is a C-I-P of application Ser. No. 09/112,802 filed on Jul. 10, 1998 now U.S. Pat. No. 6,213,589.

FIELD OF THE INVENTION

The present invention relates to ink jet printing and in particular discloses a planar thermoelastic bend actuator ink jet printer.

The present invention further relates to the field of drop on demand ink jet printing.

BACKGROUND OF THE INVENTION

Many different types of printing have been invented, a large number of which are presently in use. The known forms of print have a variety of methods for marking the print media with a relevant marking media Commonly used forms of printing include offset printing, laser printing and copying devices, dot matrix type impact printers, thermal paper printers, film recorders, thermal wax printers, dye sublimation printers and ink jet printers both of the drop on demand and continuous flow type. Each type of printer has its own advantages and problems when considering cost, speed, quality, reliability, simplicity of construction and operation etc.

In recent years, the field of ink jet printing, wherein each individual pixel of ink is derived from one or more ink nozzles has become increasingly popular primarily due to its inexpensive and versatile nature.

Many different techniques on ink jet printing have been invented. For a survey of the field, reference is made to an article by J Moore, "Non-Impact Printing: Introduction and Historical Perspective", Output Hard Copy Devices, Editors R Dubeck and S Sherr, pages 207 to 220 (1988).

Ink Jet printers themselves come in many different types. The utilization of a continuous stream of ink in ink jet printing appears to date back to at least 1929 wherein U.S. Pat. No. 1,941,001 by Hansell discloses a simple form of continuous stream electrostatic ink jet printing.

U.S. Pat. 3,596,275 by Sweet also discloses a process of a continuous ink jet printing including the step wherein the ink jet stream is modulated by a high frequency electrostatic field so as to cause drop separation. This technique is still utilized by several manufacturers including Elmjet and Scitex (see also U.S. Pat. No. 3,373,437 by Sweet et al)

Piezoelectric ink jet printers are also one form of commonly utilized ink jet printing device. Piezoelectric systems are disclosed by Kyser et. al. in U.S. Pat. No. 3,946,398 (1970) which utilizes a diaphragm mode of operation, by Zolten in U.S. Pat. No. 3,683,212 (1970) which discloses a squeeze mode of operation of a piezoelectric crystal, Stemme in U.S. Pat. No. 3,747,120 (1972) discloses a bend mode of piezoelectric operation, Howkins in U.S. Pat. No. 4,459,601 discloses a piezoelectric push mode actuation of the ink jet stream and Fischbeck in U.S. Pat. No. 4,584,590 which discloses a shear mode type of piezoelectric transducer element.

Recently, thermal ink jet printing has become an extremely popular form of ink jet printing. The ink jet printing techniques include those disclosed by Endo et al in GB 2007162 (1979) and Vaught et al in U.S. Pat. No. 4,490,728. Both the aforementioned references disclosed ink jet printing techniques that rely upon the activation of an electrothermal actuator which results in the creation of a bubble in a constricted space, such as a nozzle, which thereby causes the ejection of ink from an aperture connected to the confined space onto a relevant print media. Printing devices utilizing the electrothermal actuator are manufactured by manufacturers such as Canon and Hewlett Packard.

As can be seen from the foregoing, many different types of printing technologies are available. Ideally, a printing technology should have a number of desirable attributes. These include inexpensive construction and operation, high speed operation, safe and continuous long term operation etc. Each technology may have its own advantages and disadvantages in the areas of cost, speed, quality, reliability, power usage, simplicity of construction operation, durability and consumables.

SUMMARY OF THE INVENTION

According to the invention there is provided an ink jet nozzle assembly including a nozzle chamber having a nozzle, the chamber including a movable portion configured for movement to effect ejection of ink from the chamber via said nozzle, the assembly further including an actuator attached to or formed integrally with the movable portion, the actuator having an electrically conductive portion and an electrically resistive portion such that upon passing a current through both said portions, said actuator is caused to deform elastically to effect said movement of said movable portion.

Preferably said electrically conductive portion and said electrically resistive portion are respective surfaces of a thermal actuator arm.

According to the invention there is further provided an ink jet nozzle assembly including:

a nozzle chamber having an inlet in fluid communication with an ink reservoir and a nozzle through which ink from the chamber can be ejected;

a chamber including a fixed portion and a movable portion, relative movement between the fixed portion and the movable portion in an ejection phase reducing an effective volume of the chamber, and alternate movement in a refill phase enlarging the effective volume of the chamber; and a thermal actuator to eject ink from said nozzle chamber via said nozzle, said thermal actuator comprising a lower planar surface constructed from a highly electrically conductive material interconnected to an upper planar surface constructed from an electrically resistive material such that upon passing a current between said planar surfaces, said thermal actuator is caused to bend so as to effect movement of said movable portion and cause ink to be ejected through said nozzle.

Preferably the movable portion includes the nozzle and the fixed portion is mounted on a substrate.

Preferably the fixed portion includes the nozzle mounted on a substrate.

Preferably said actuator is attached to a substrate and further includes a stiff paddle portion which increases bending of said actuator near a point where it is attached to the substrate.

Preferably said stiff paddle is formed of silicon nitride.

Preferably said actuator further includes an expansion coating having a high coefficient of thermal expansion on top of said upper planar surface so as to increase bending of said actuator.

Preferably said expansion coating comprises substantially polytetrafluoroethylene.

Preferably between said upper planar surface and said lower planar surface there is provided a gap, formed upon etching away of a deposited sacrificial material.

Preferably said upper planar surface includes a plurality of etchant holes provided so as to allow a more rapid etching of said sacrificial layer during construction.

Preferably said upper planar surface comprises substantially Indium Tin Oxide (ITO).

Preferably said lower planar surface comprises substantially metal.

Preferably said upper and lower surfaces are further coated with a passivation material.

Preferably said nozzle is formed on a silicon wafer using micro-electro mechanical systems construction techniques.

BRIEF DESCRIPTION OF THE DRAWINGS

Notwithstanding any other forms which may fall within the scope of the present invention, preferred forms of the invention will now be described, by way of example only, with reference to the accompanying drawings, in which.

DESCRIPTION OF PREFERRED AND OTHER EMBODIMENTS

In the preferred embodiment, there is provided an ink jet printer having nozzle chambers. Each nozzle chamber includes a thermoelastic bend actuator that utilizes a planar resistive material in the construction of the bend actuator. The bend actuator is activated when it is required to eject ink from a chamber.

Figure 1:
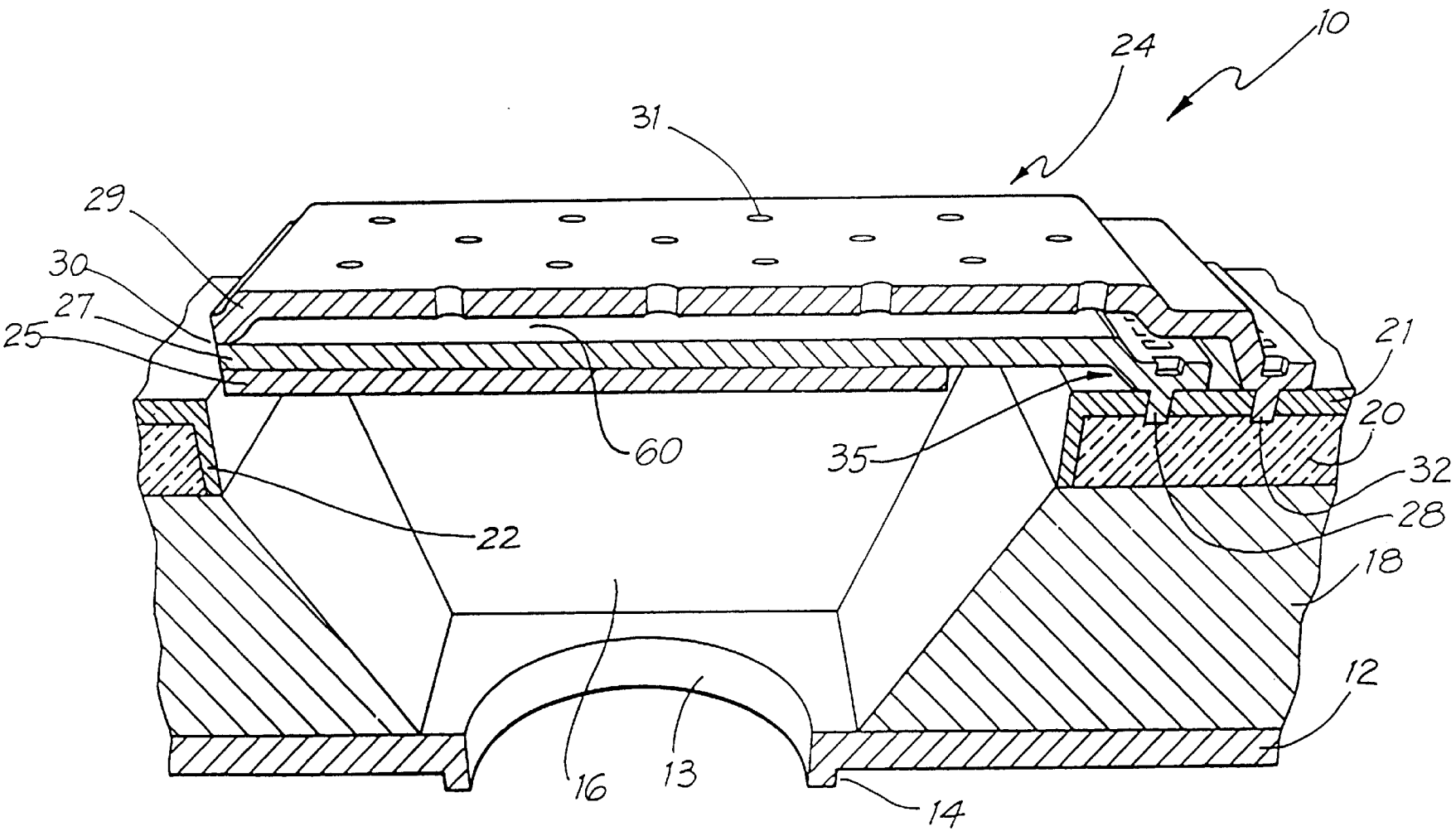
FIG. 1 is cross-sectional view, partly in section, of a single ink jet nozzle constructed in accordance with an embodiment of the present invention.

Turning now to FIG. 1, there is illustrated a cross-sectional view, partly in section of a nozzle arrangement 10 as constructed in accordance with the preferred embodiment. The nozzle arrangement 10 can be formed as part of an array of nozzles fabricated on a semi-conductor wafer utilizing techniques known in the production of micro-electro-mechanical systems (MEMS). For a general introduction to a micro-electric mechanical system (MEMS) reference is made to standard proceedings in this field including the proceedings of the SPIE (International Society for Optical Engineering), volumes 2642 and 2882 which contain the proceedings for recent advances and conferences in this field. The nozzle arrangement 10 includes a boron doped silicon wafer layer 12 which can be constructed by a back etching a silicon wafer 18 which has a buried boron doped epitaxial layer. The boron doped layer can be further etched so as to define a nozzle hole 13 and rim 14.

The nozzle arrangement 10 includes a nozzle chamber 16 which can be constructed by utilization of an anisotropic crystallographic etch of the silicon portions 18 of the wafer.

On top of the silicon portions 18 is included a glass layer 20 which can comprise CMOS drive circuitry including a two level metal layer (not shown) so as to provide control and drive circuitry for the thermal actuator. On top of the CMOS glass layer 20 is provided a nitride layer 21 which includes side portions 22 which act to passivate lower layers from etching that is utilized in construction of the nozzle arrangement 10. The nozzle arrangement 10 includes a paddle actuator 24 which is constructed on a nitride base 25 which acts to form a rigid paddle for the overall actuator 24. Next, an aluminum layer 27 is provided with the aluminum layer 27 being interconnected by vias 28 with the lower CMOS circuitry so as to form a first portion of a circuit. The aluminum layer 27 is interconnected at a point 30 to an Indium Tin Oxide (ITO) layer 29 which provides for resistive heating on demand. The ITO layer 29 includes a number of etch holes 31 for allowing the etching away of a lower level sacrificial layer which is formed between the layers 27, 29. The ITO layer is further connected to the lower glass CMOS circuitry layer by via 32. On top of the ITO layer 29 is optionally provided a polytetrafluoroethylene layer (not shown) which provides for insulation and further rapid expansion of the top layer 29 upon heating as a result of passing a current through the bottom layer 27 and ITO layer 29.

The back surface of the nozzle arrangement 10 is placed in an ink reservoir so as to allow ink to flow into nozzle chamber 16. When it is desired to eject a drop of ink, a current is passed through the aluminum layer 27 and ITO layer 29. The aluminum layer 27 provides a very low resistance path to the current whereas the ITO layer 29 provides a high resistance path to the current. Each of the layers 27, 29 are passivated by means of coating by a thin nitride layer (not shown) so as to insulate and passivate the layers from the surrounding ink. Upon heating of the ITO layer 29 and optionally PTFE layer, the top of the actuator 24 expands more rapidly than the bottom portions of the actuator 24. This results in a rapid bending of the actuator 24, particularly around the point 35 due to the utilization of the rigid nitride paddle arrangement 25. This accentuates the downward movement of the actuator 24 which results in the ejection of ink from ink ejection nozzle 13.

Between the two layers 27, 29 is provided a gap 60 which can be constructed via utilization of etching of sacrificial layers so as to dissolve away sacrificial material between the two layers. Hence, in operation ink is allowed to enter this area and thereby provides a further cooling of the lower surface of the actuator 24 so as to assist in accentuating the bending. Upon de-activation of the actuator 24, it returns to its quiescent position above the nozzle chamber 16. The nozzle chamber 16 refills due to the surface tension of the ink through the gaps between the actuator 24 and the nozzle chamber 16.

The PTFE layer has a high coefficient of thermal expansion and therefore further assists in accentuating any bending of the actuator 24. Therefore, in order to eject ink from the nozzle chamber 16, a current is passed through the planar layers 27, 29 resulting in resistive heating of the top layer 29 which further results in a general bending down of the actuator 24 resulting in the ejection of ink.

The nozzle arrangement 10 is mounted on a second silicon chip wafer which defines an ink reservoir channel to the back of the nozzle arrangement 10 for resupply of ink.

Figure 2:
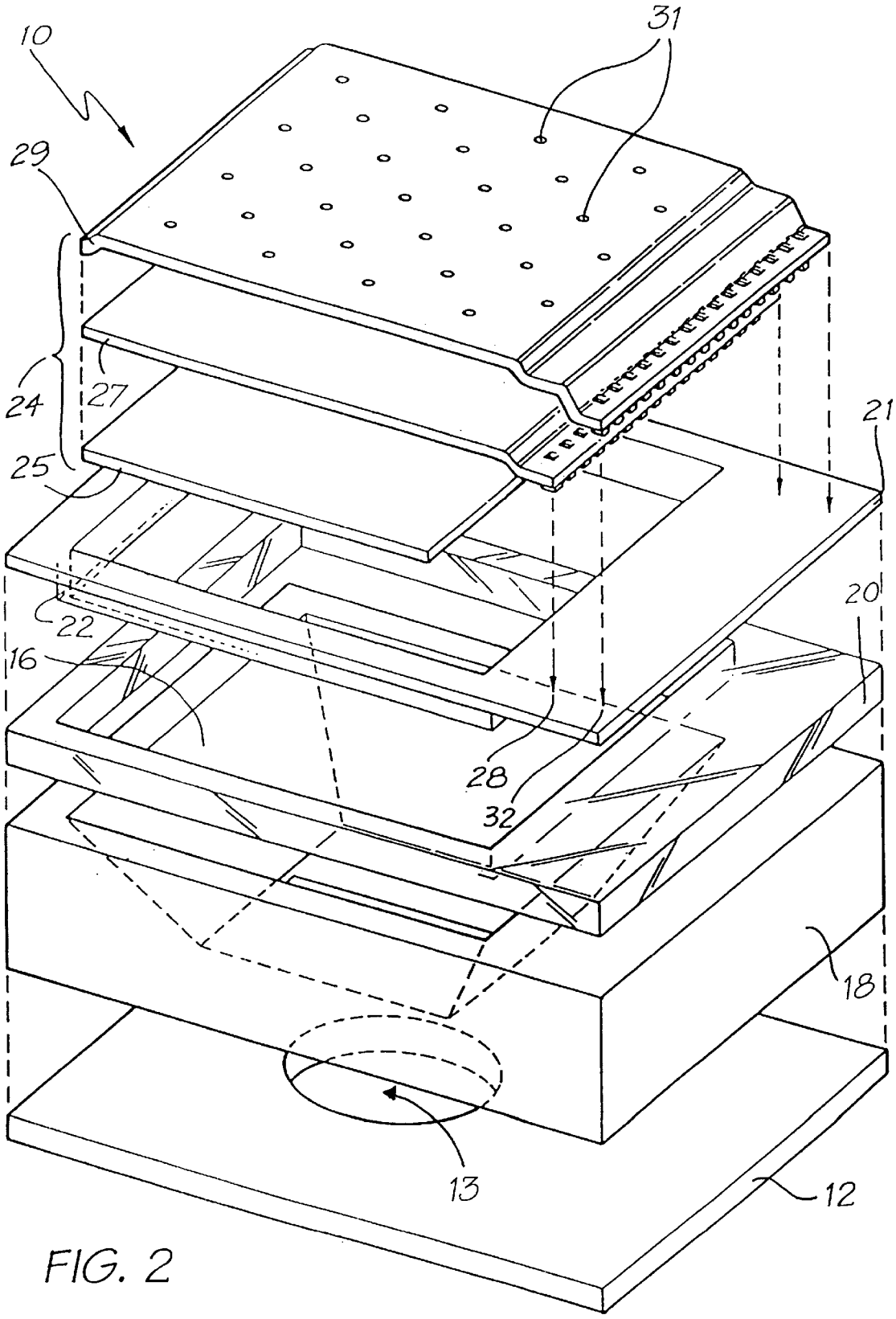
FIG. 2 is an exploded perspective view illustrating the construction of a single ink jet nozzle in accordance with an embodiment of the present invention.

Turning now to FIG. 2, there is illustrated an exploded perspective view illustrating the various layers of a nozzle arrangement 10. The arrangement 10 can, as noted previously, be constructed from back etching to the boron doped layer. The actuator 24 can further be constructed through the utilization of a sacrificial layer filling the nozzle chamber 16 and the depositing of the various layers 25, 27, 29 and optional PTFE layer before sacrificially etching the nozzle chamber 16 in addition to the sacrificial material in area 60. To this end, the nitride layer 21 includes side portions 22 which act to passivate the portions of the lower glass layer 20 which would otherwise be attacked as a result of sacrificial etching.

One form of detailed manufacturing process which can be used to fabricate monolithic ink jet print heads operating in accordance with the principles taught by the present embodiment can proceed utilizing the following steps:

1. Using a double sided polished wafer deposit 3 microns of epitaxial silicon heavily doped with boron 12.

2. Deposit 10 microns of epitaxial silicon 18, either p-type or n-type, depending upon the CMOS process used.

Figure 3:
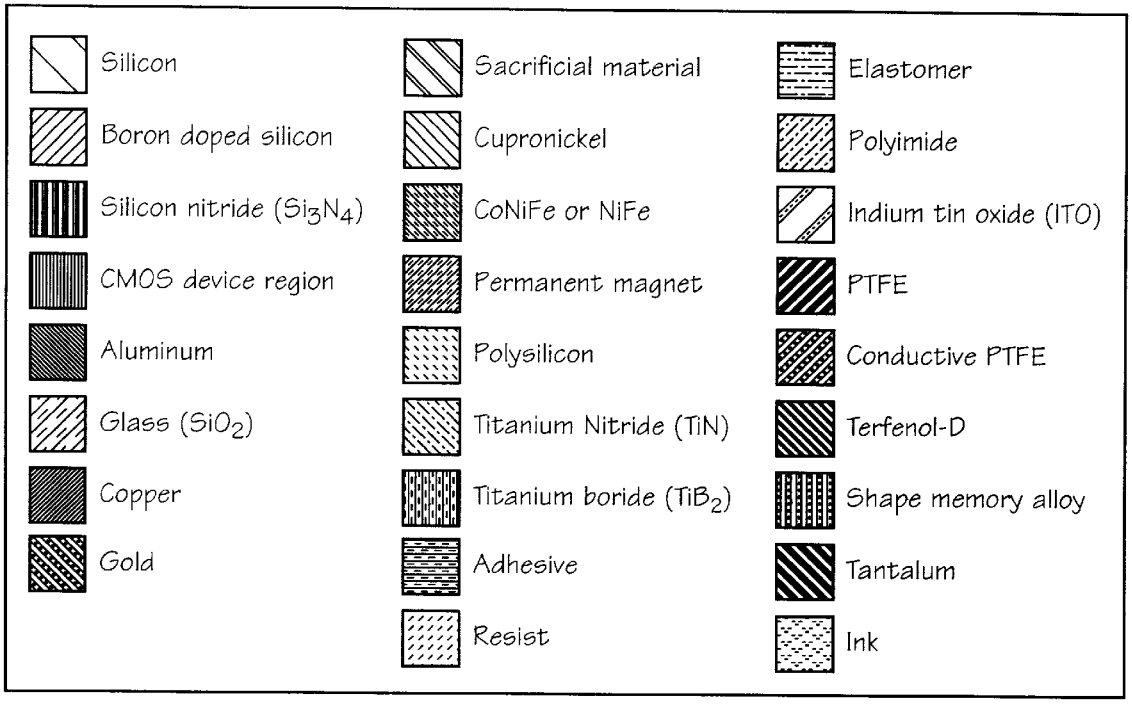
FIG. 3 provides a legend of the materials indicated in FIGS. 4 to 19.
Figure 4:
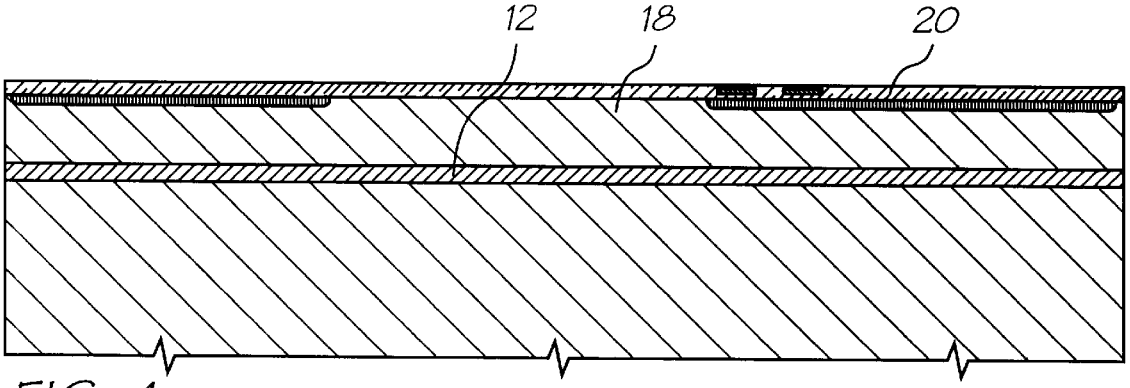
FIG. 4 to FIG. 19 illustrate sectional views of the manufacturing steps in one form of construction of an ink jet printhead nozzle.

3. Complete a 0.5 micron, one poly, 2 metal CMOS process 20. This step is shown in FIG. 4. For clarity, these diagrams may not be to scale, and may not represent a cross section though any single plane of the nozzle. FIG. 3 is a key to representations of various materials in these manufacturing diagrams, and those of other cross referenced ink jet configurations.

Figure 5:
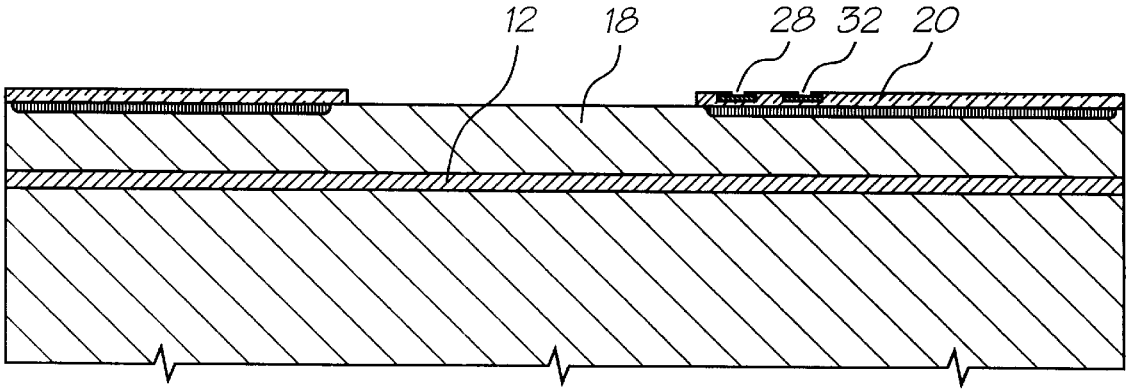

4. Etch the CMOS oxide layers down to silicon 18 or second level metal using Mask 1. This mask defines the nozzle cavity and the bend actuator electrode contact vias 28, 32. This step is shown in FIG. 5.

Figure 6:
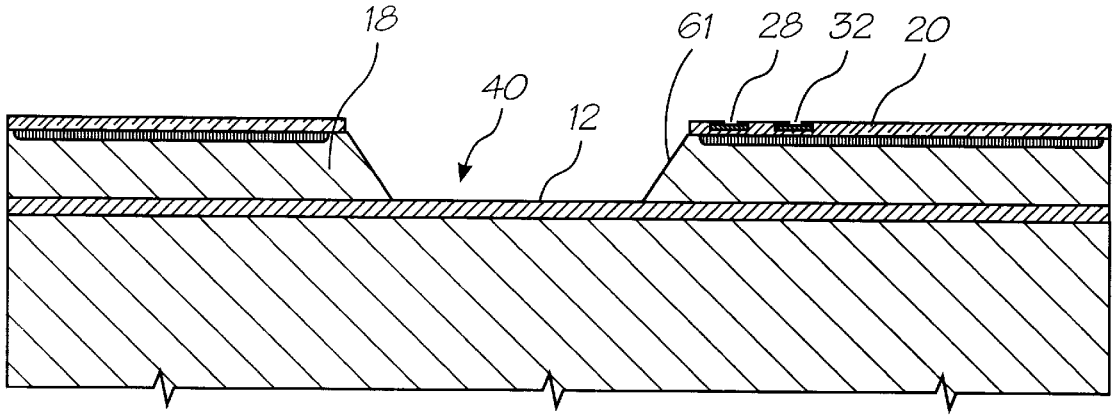

5. Crystallographically etch the exposed silicon 18 using KOH as shown at 40. This etch stops on <111> crystallographic planes 61, and on the boron doped silicon buried layer 12. This step is shown in FIG. 6.

Figure 7:
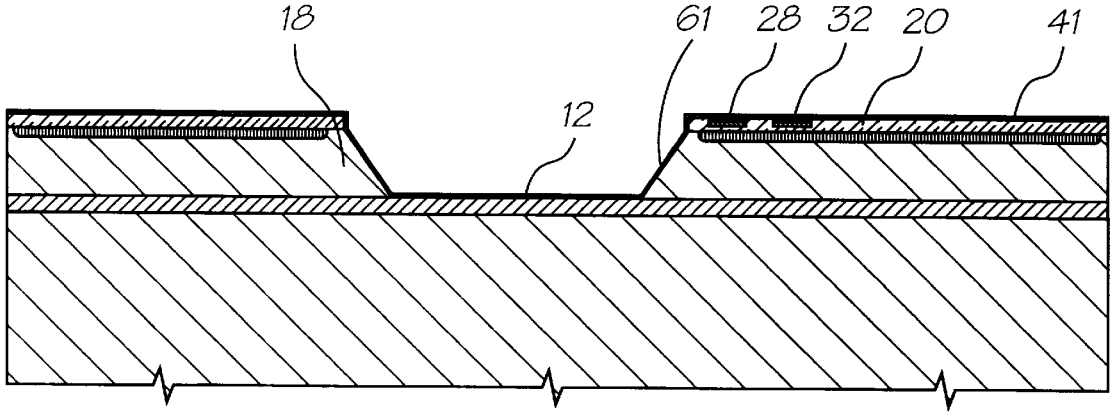

6. Deposit 0.5 microns of low stress PECVD silicon nitride 41 (Si3N4). The nitride 41 acts as an ion diffusion barrier. This step is shown in FIG. 7.

Figure 8:
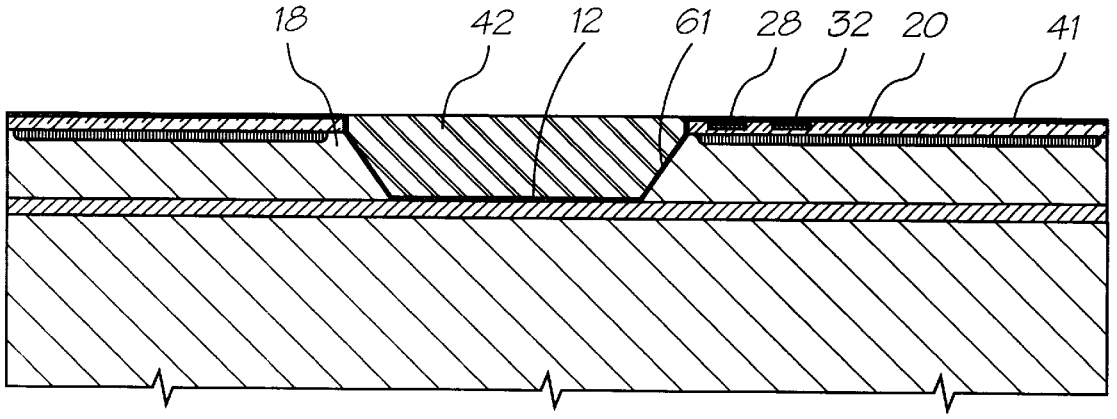

7. Deposit a thick sacrificial layer 42 (e.g. low stress glass), filling the nozzle cavity. Planarize the sacrificial layer 42 down to the nitride 41 surface. This step is shown in FIG. 8.

8. Deposit 1 micron of tantalum 43. This layer acts as a stiffener for the bend actuator.

Figure 9:
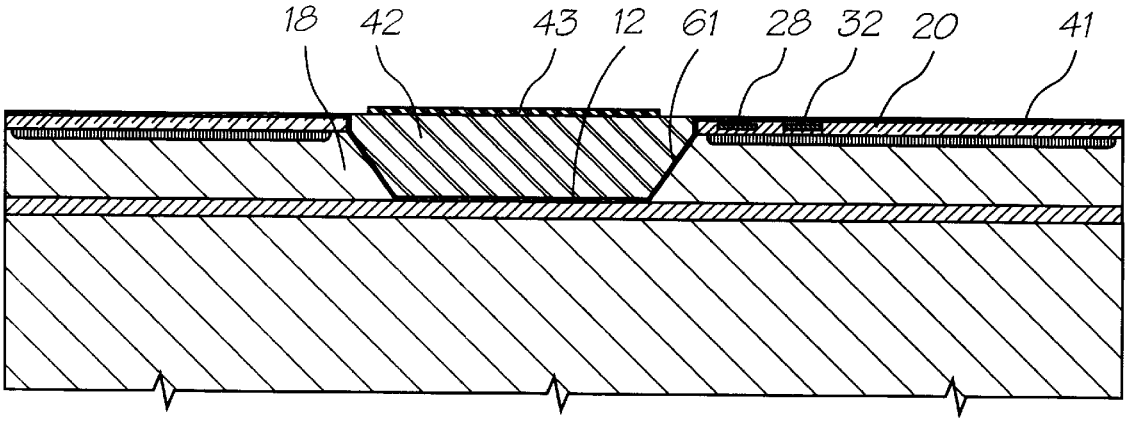

9. Etch the tantalum 43 using Mask 2. This step is shown in FIG. 9. This mask defines the space around the stiffener section of the bend actuator, and the electrode contact vias.

Figure 10:
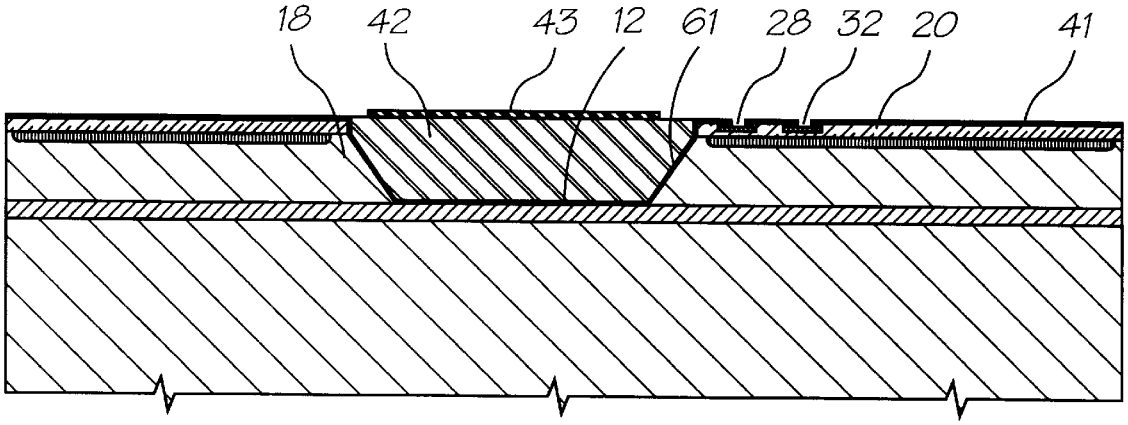

10. Etch nitride 41 still using Mask 2. This clears the nitride from the electrode contact vias 28, 32. This step is shown in FIG. 10.

Figure 11:
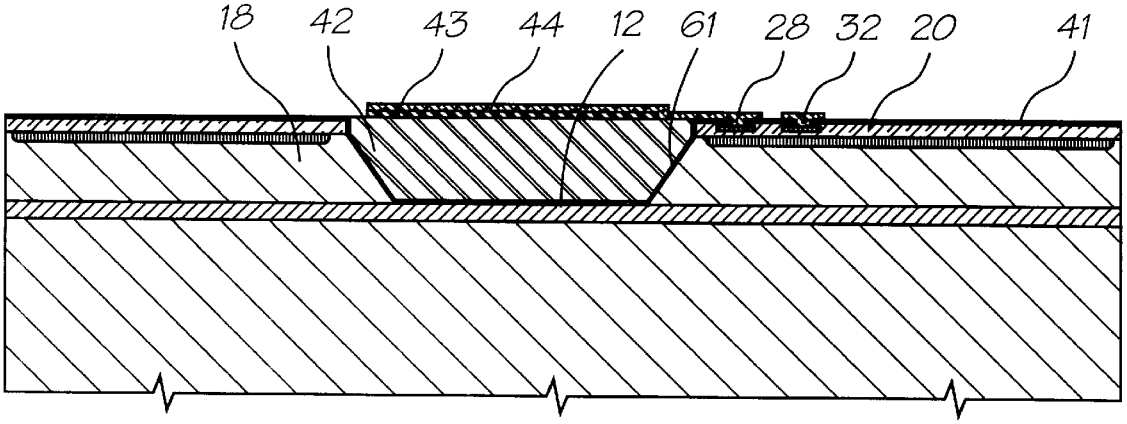

11. Deposit one micron of gold 44, patterned using Mask 3. This may be deposited in a lift-off process. Gold is used for its corrosion resistance and low Young's modulus. This mask defines the lower conductor of the bend actuator. This step is shown in FIG. 11.

12. Deposit 1 micron of thermal blanket 45. This material should be a non-conductive material with a very low Young's modulus and a low thermal conductivity, such as an elastomer or foamed polymer.

Figure 12:
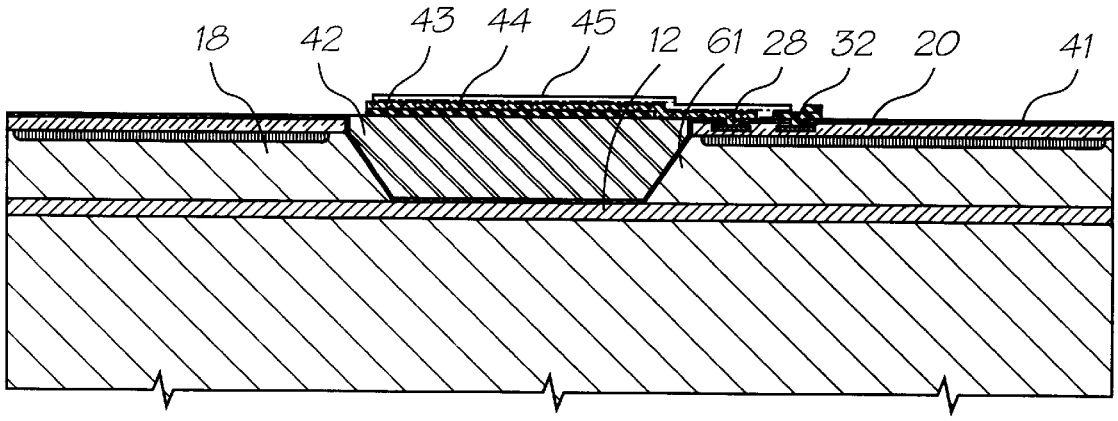

13. Pattern the thermal blanket 45 using Mask 4. This mask defines the contacts between the upper and lower conductors, and the upper conductor and the drive circuitry. This step is shown in FIG. 12.

14. Deposit 1 micron of a material 46 with a very high resistivity (but still conductive), a high Young's modulus, a low heat capacity, and a high coefficient of thermal expansion. A material such as indium tin oxide (ITO) may be used, depending upon the dimensions of the bend actuator.

Figure 13:
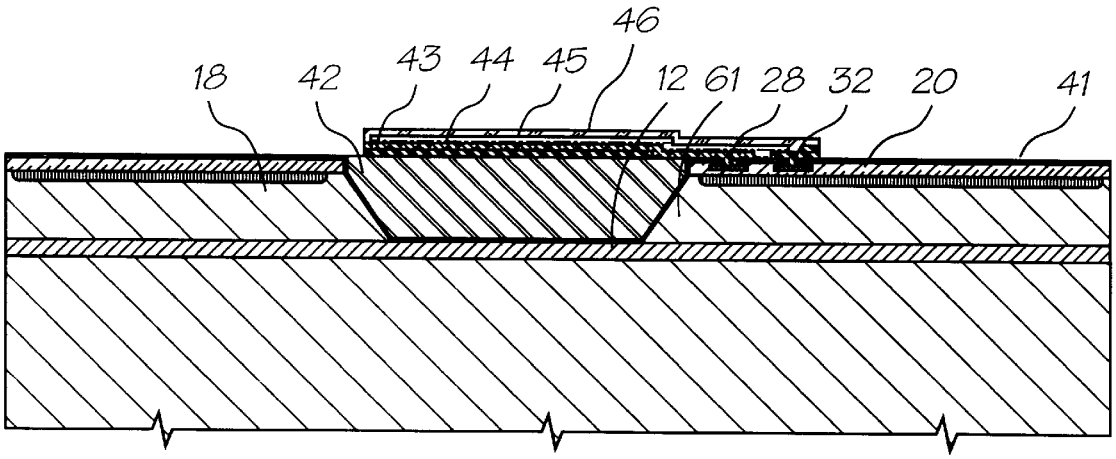

15. Pattern the ITO 46 using Mask 5. This mask defines the upper conductor of the bend actuator. This step is shown in FIG. 13.

16. Deposit a further 1 micron of thermal blanket 47.

Figure 14:
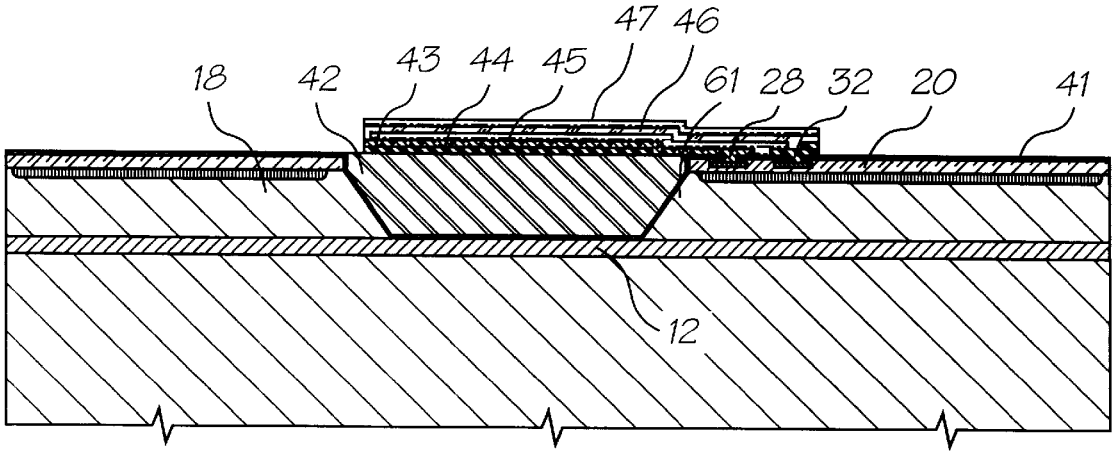

17. Pattern the thermal blanket 47 using Mask 6. This mask defines the bend actuator, and allows ink to flow around the actuator into the nozzle cavity. This step is shown in FIG. 14.

Figure 15:
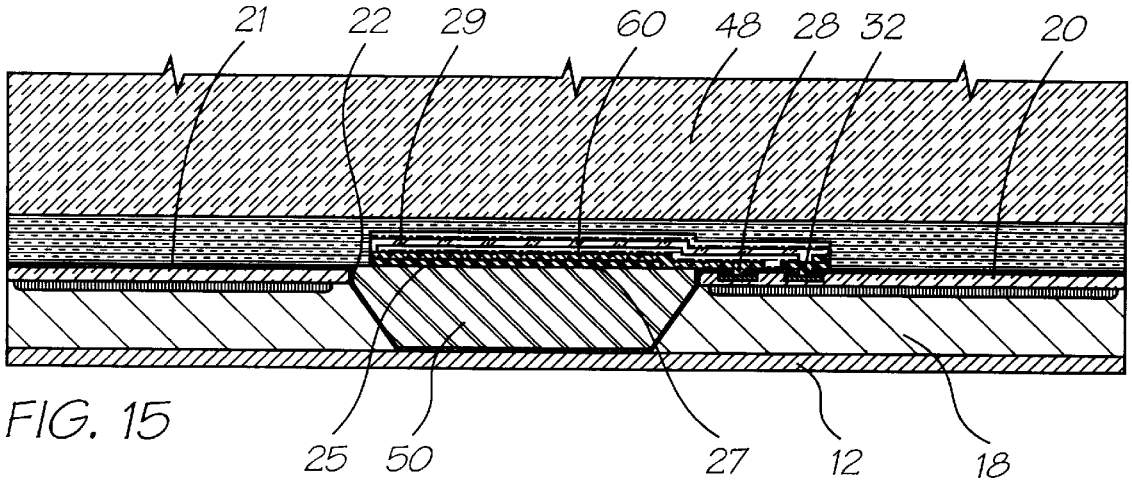

18. Mount the wafer on a glass blank 48 and back-etch the wafer using KOH, with no mask. This etch thins the wafer and stops at the buried boron doped silicon layer 12. This step is shown in FIG. 15.

Figure 16:
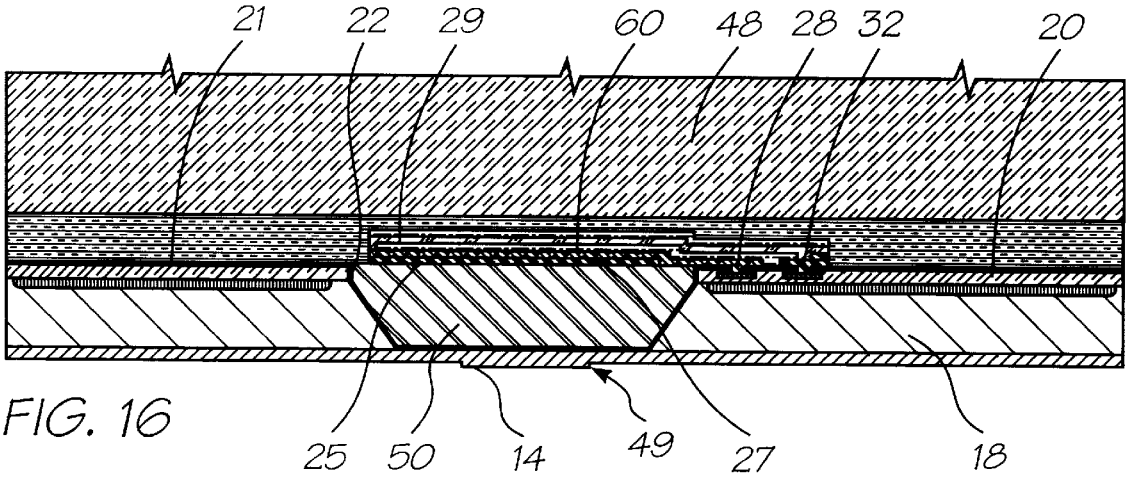

19. Plasma back-etch the boron doped silicon layer 12 to a depth of 1 micron using Mask 7. This mask defines the nozzle rim 14. This step is shown in FIG. 16.

20. Plasma back-etch through the boron doped layer 12 using Mask 8. This mask defines the nozzle 13, and the edge of the chips.

Figure 17:
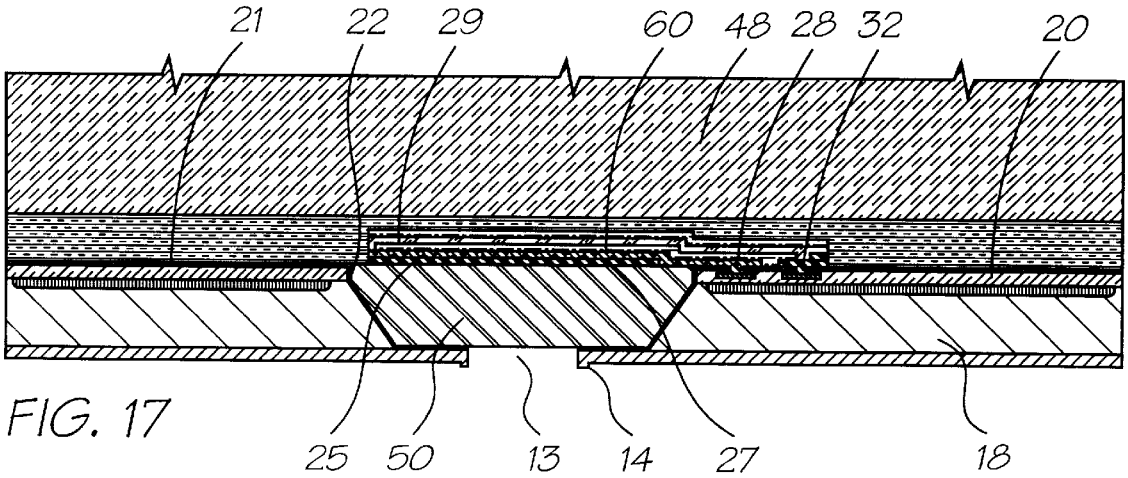

21. Plasma back-etch nitride 41 up to the glass sacrificial layer 42 through the holes in the boron doped silicon layer 12. At this stage, the chips are separate, but are still mounted on the glass blank. This step is shown in FIG. 17.

22. Strip the adhesive layer to detach the chips from the glass blank 48.

Figure 18:
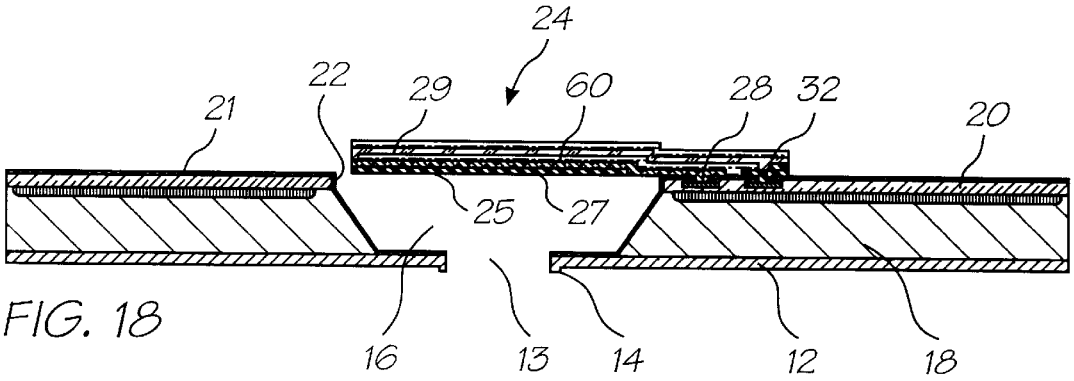

23. Etch the sacrificial glass layer 42 in buffered HF. This step is shown in FIG. 18.

24. Mount the printheads in their packaging, which may be a molded plastic former incorporating ink channels which supply different colors of ink to the appropriate regions of the front surface of the wafer.

25. Connect the printheads to their interconnect systems.

26. Hydrophobize the front surface of the printheads.

Figure 19:
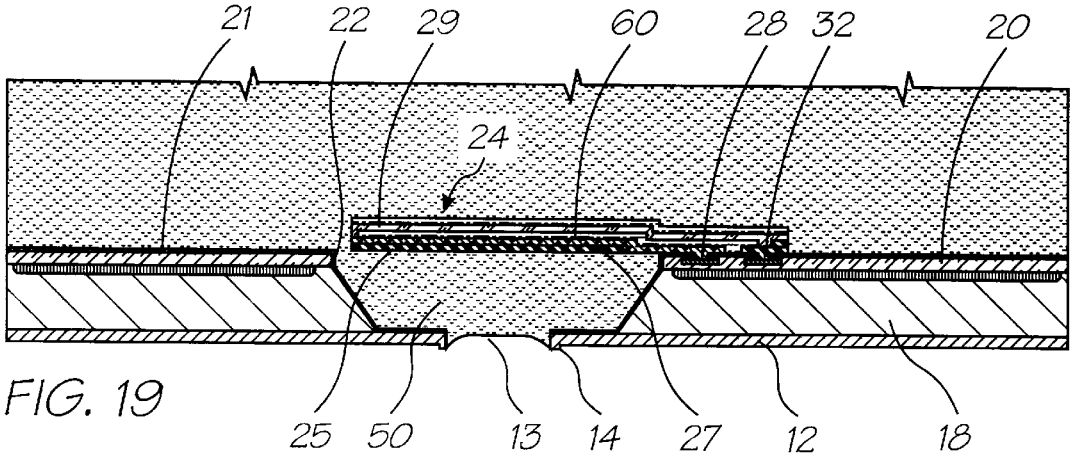

27. Fill the completed printheads with ink and test them. A filled nozzle is shown in FIG. 19.

Figure 20:
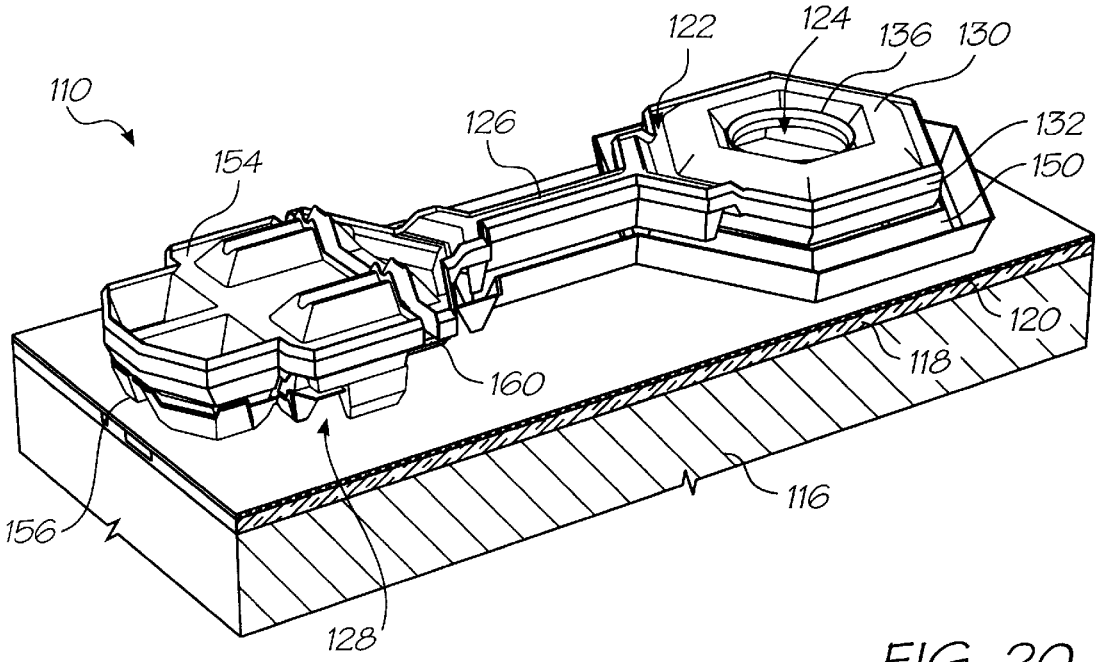
FIG. 20 shows a three dimensional, schematic view of a nozzle assembly for an ink jet printhead in accordance with another embodiment of the invention.

Referring now to FIG. 20 of the drawings, a nozzle assembly, in accordance with a further embodiment of the invention is designated generally by the reference numeral 110. An ink jet printhead has a plurality of nozzle assemblies 110 arranged in an array 114 (FIGS. 24 and 25) on a silicon substrate 116. The array 114 will be described in greater detail below.

The assembly 110 includes a silicon substrate or wafer 116 on which a dielectric layer 118 is deposited. A CMOS passivation layer 120 is deposited on the dielectric layer 118.

Each nozzle assembly 110 includes a nozzle 122 defining a nozzle opening 124, a connecting member in the form of a lever arm 126 and an actuator 128. The lever arm 126 connects the actuator 128 to the nozzle 122.

Figure 21:
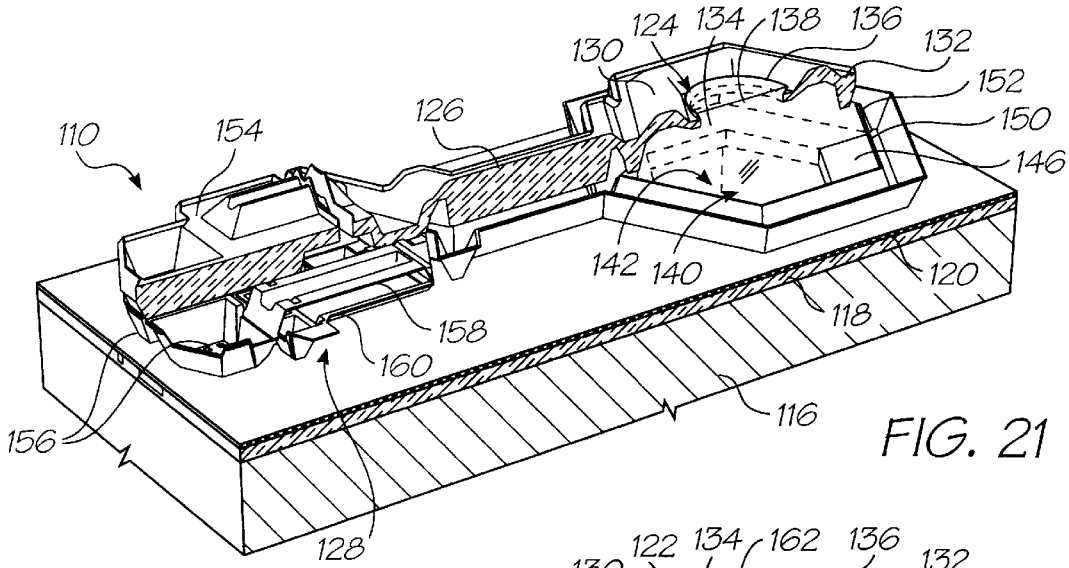
FIGS. 21 to 23 show a three dimensional, schematic illustration of an operation of the nozzle assembly of FIG. 20.
Figure 22:
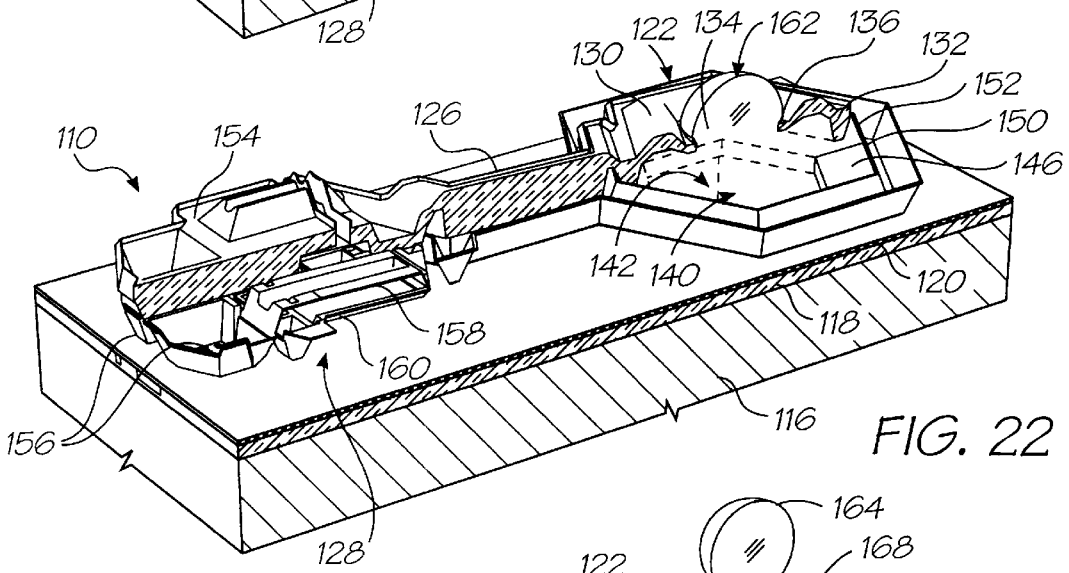
Figure 23:
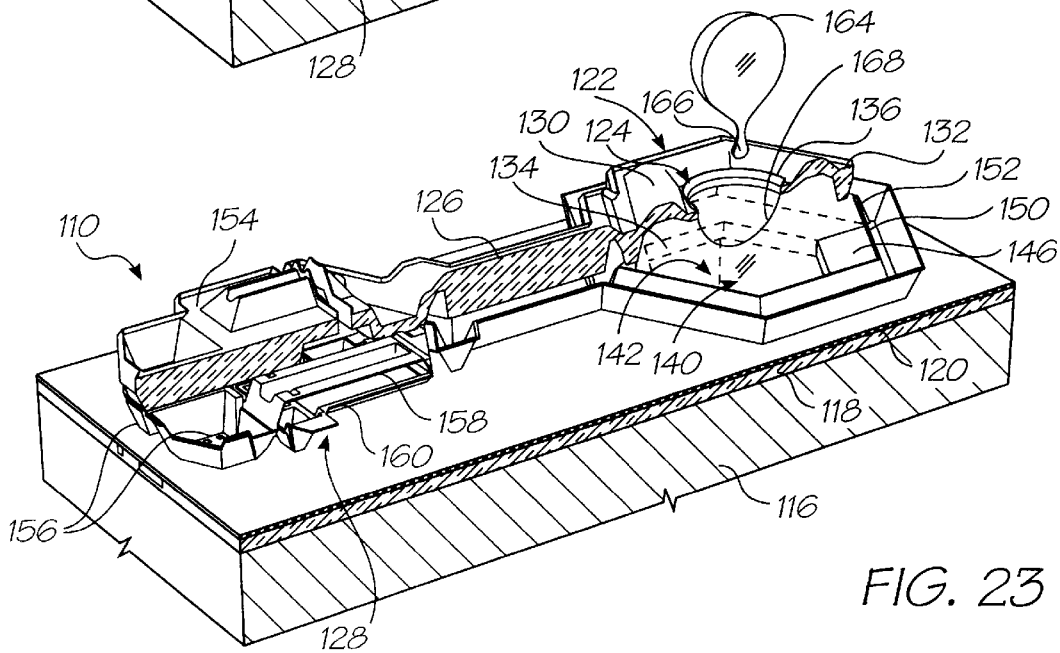

As shown in greater detail in FIGS. 21 to 23 of the drawings, the nozzle 122 comprises a crown portion 130 with a skirt portion 132 depending from the crown portion 130. The skirt portion 132 forms part of a peripheral wall of a nozzle chamber 134 (FIGS. 21 to 23 of the drawings). The nozzle opening 124 is in fluid communication with the nozzle chamber 134. It is to be noted that the nozzle opening 124 is surrounded by a raised rim 136 which "pins" a meniscus 138 (FIG. 21) of a body of ink 140 in the nozzle chamber 134.

An ink inlet aperture 142 (shown most clearly in FIG. 25) is defined in a floor 146 of the nozzle chamber 134. The aperture 142 is in fluid communication with an ink inlet channel 148 defined through the substrate 116.

A wall portion 150 bounds the aperture 142 and extends upwardly from the floor portion 146. The skirt portion 132, as indicated above, of the nozzle 122 defines a first part of a peripheral wall of the nozzle chamber 134 and the wall portion 150 defines a second part of the peripheral wall of the nozzle chamber 134.

The wall 150 has an inwardly directed lip 152 at its free end which serves as a fluidic seal which inhibits the escape of ink when the nozzle 122 is displaced, as will be described in greater detail below. It will be appreciated that, due to the viscosity of the ink 140 and the small dimensions of the spacing between the lip 152 and the skirt portion 132, the inwardly directed lip 152 and surface tension function as a seal for inhibiting the escape of ink from the nozzle chamber 134.

The actuator 128 is a thermal bend actuator and is connected to an anchor 154 extending upwardly from the substrate 116 or, more particularly, from the CMOS passivation layer 120. The anchor 154 is mounted on conductive pads 156 which form an electrical connection with the actuator 128.

The actuator 128 comprises a first, active beam 158 arranged above a second, passive beam 160. In a preferred embodiment, both beams 158 and 160 are of, or include, a conductive ceramic material such as titanium nitride (TiN).

Both beams 158 and 160 have their first ends anchored to the anchor 154 and their opposed ends connected to the arm 126. When a current is caused to flow through the active beam 158 thermal expansion of the beam 158 results. As the passive beam 160, through which there is no current flow, does not expand at the same rate, a bending moment is created causing the arm 126 and, hence, the nozzle 122 to be displaced downwardly towards the substrate 116 as shown in FIG. 22 of the drawings. This causes an ejection of ink through the nozzle opening 124 as shown at 162 in FIG. 22 of the drawings. When the source of heat is removed from the active beam 158, i.e. by stopping current flow, the nozzle 122 returns to its quiescent position as shown in FIG. 23 of the drawings. When the nozzle 122 returns to its quiescent position, an ink droplet 164 is formed as a result of the breaking of an ink droplet neck as illustrated at 166 in FIG. 23 of the drawings. The ink droplet 164 then travels on to the print media such as a sheet of paper. As a result of the formation of the ink droplet 164, a "negative" meniscus is formed as shown at 168 in FIG. 23 of the drawings. This "negative" meniscus 168 results in an inflow of ink 140 into the nozzle chamber 134 such that a new meniscus 138 (FIG. 21) is formed in readiness for the next ink drop ejection from the nozzle assembly 110.

Figure 24:
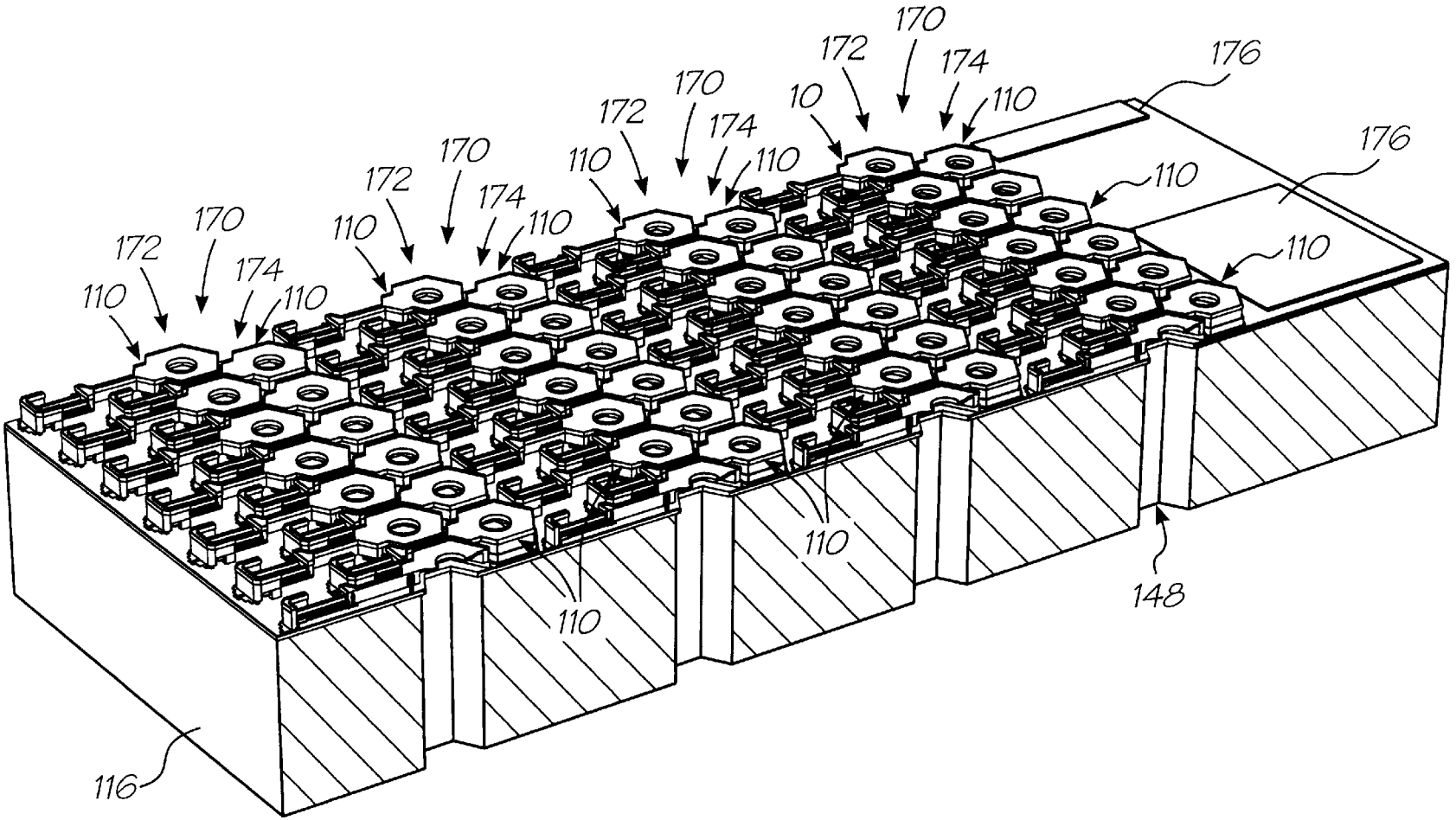
FIG. 24 shows a three dimensional view of a nozzle array constituting an ink jet printhead.
Figure 25:
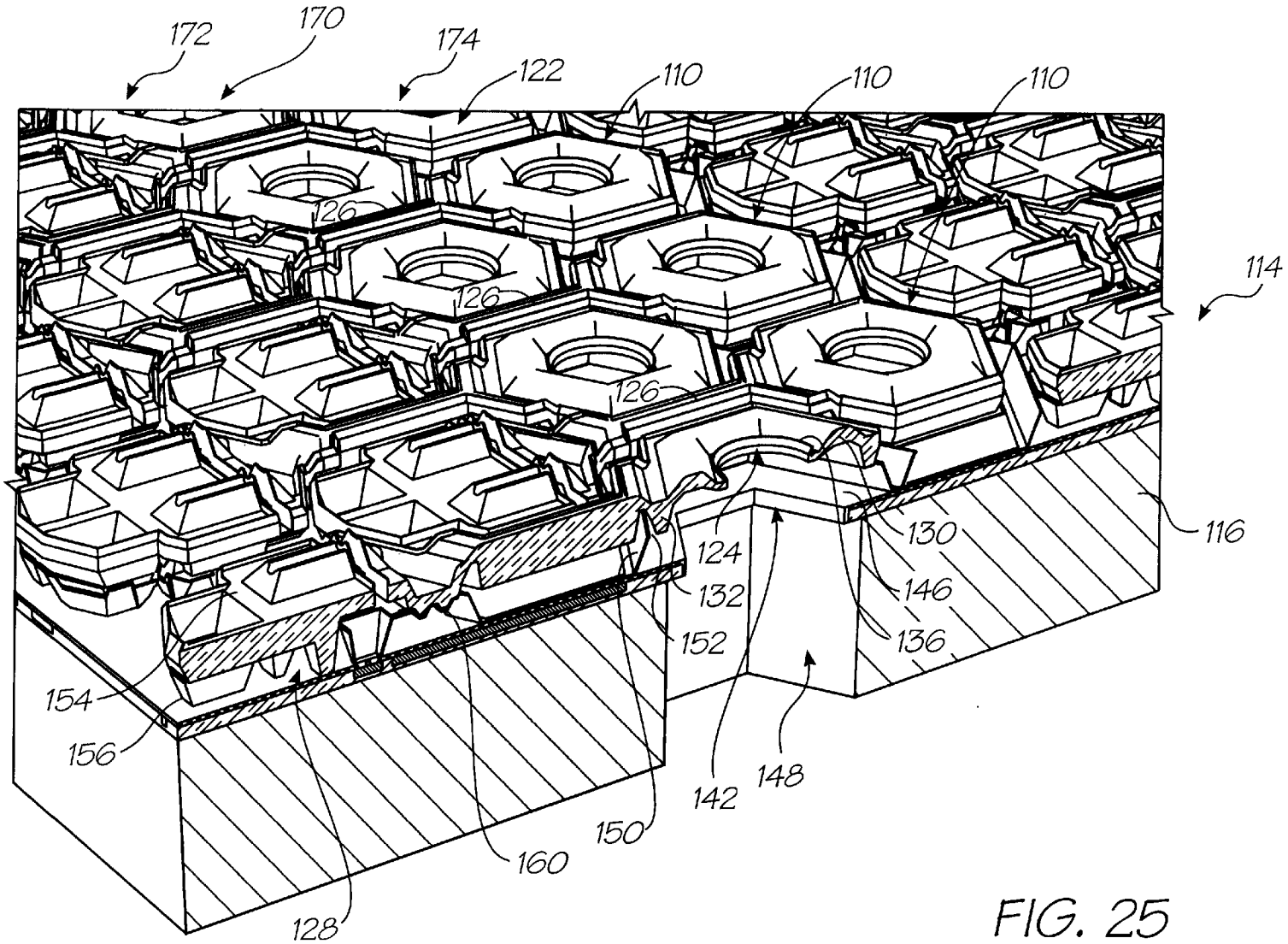
FIG. 25 shows, on an enlarged scale, part of the array of FIG. 24.

Referring now to FIGS. 24 and 25 of the drawings, the nozzle array 114 is described in greater detail. The array 114 is for a four color printhead. Accordingly, the array 114 includes four groups 170 of nozzle assemblies, one for each color. Each group 170 has its nozzle assemblies 110 arranged in two rows 172 and 174. One of the groups 170 is shown in greater detail in FIG. 25 of the drawings.

Figure 31A:
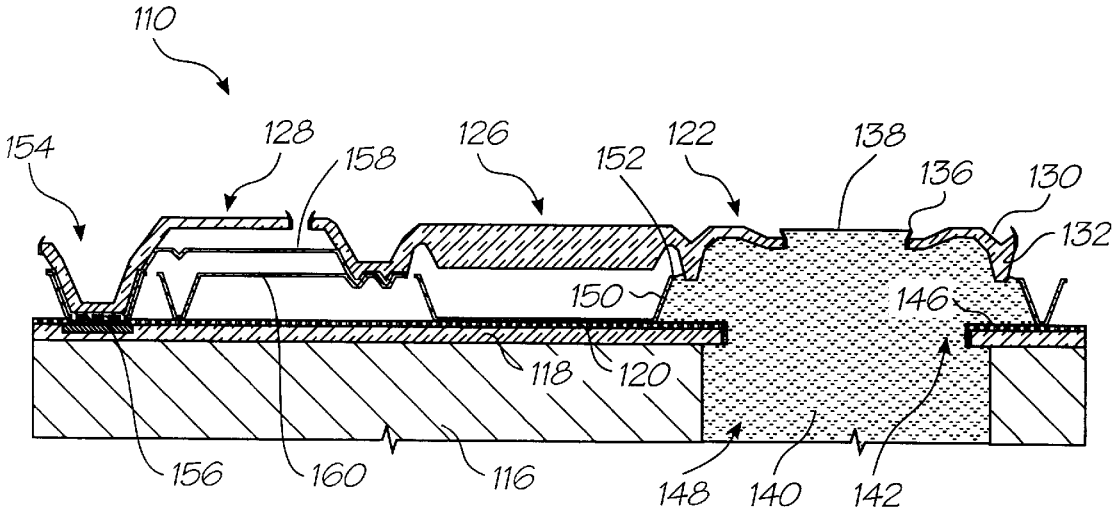
FIGS. 31*a* to 31*c* show sectional side views of an operation of the nozzle assembly manufactured according to the method of FIGS. 27 and 28.
Figure 31B:
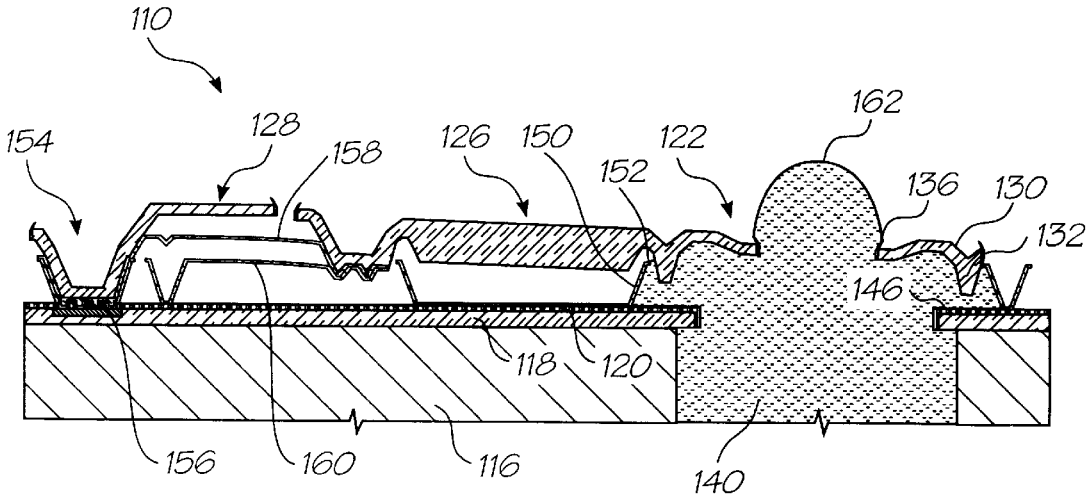
Figure 31C:
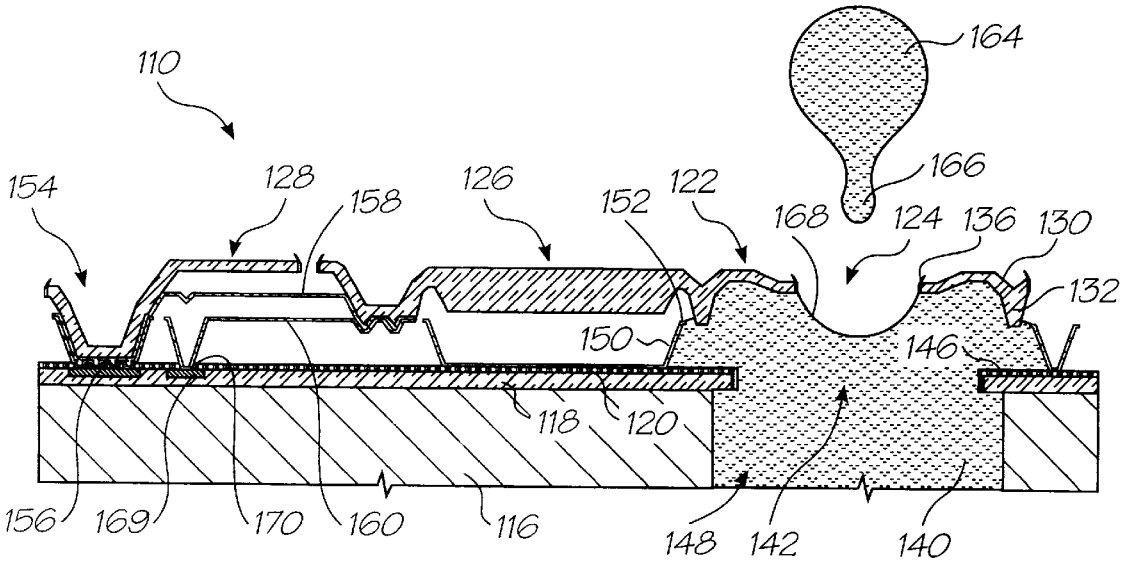

FIG. 31*c* shows a sectional side view of the nozzle assembly manufactured according to the method of FIGS. 27 and 28. However, it also shows (in accordance with a minor modification to the invention) an aluminum contact pad 169 situated beneath the passivation layer 120. A hole 170 is formed in the passivation layer 120 to enable the lower-most extremity of actuator arm 160 to make electrical contact with the contact aluminum 169. As an alternative to the arm 160 being "passive" as noted above, the arm 158 and the arm 160 could be referred to comparatively as "electrically resistive" and "electrically conductive" respectively. That is, actuator arm 158 could be resistive compared to actuator arm 160 which is conductive. As a potential difference is applied between conductive pads 156 and the contact aluminum 169, arm 158 heats up, but arm 160 comparatively does not. This differential expansion causes the actuator to move downwardly to cause the ejection of a droplet of ink 164. That is, the same current passes through arm 158 and arm 160, but the low resistance of arm 160 means that the Voltage drop across arm 160 is less than that across arm 158, and therefore arm 160 experiences less Joule heating than arm 158.

To facilitate close packing of the nozzle assemblies 110 in the rows 172 and 174, the nozzle assemblies 110 in the row 174 are offset or staggered with respect to the nozzle assemblies 110 in the row 172. Also, the nozzle assemblies 110 in the row 172 are spaced apart sufficiently far from each other to enable the lever arms 126 of the nozzle assemblies 110 in the row 174 to pass between adjacent nozzles 122 of the assemblies 110 in the row 172. It is to be noted that each nozzle assembly 110 is substantially dumbbell shaped so that the nozzles 122 in the row 172 nest between the nozzles 122 and the actuators 128 of adjacent nozzle assemblies 110 in the row 174.

Further, to facilitate close packing of the nozzles 122 in the rows 172 and 174, each nozzle 122 is substantially hexagonally shaped.

It will be appreciated by those skilled in the art that, when the nozzles 122 are displaced towards the substrate 116, in use, due to the nozzle opening 124 being at a slight angle with respect to the nozzle chamber 134 ink is ejected slightly off the perpendicular. It is an advantage of the arrangement shown in FIGS. 24 and 25 of the drawings that the actuators 128 of the nozzle assemblies 110 in the rows 172 and 174 extend in the same direction to one side of the rows 172 and 174. Hence, the ink droplets ejected from the nozzles 122 in the row 172 and the ink droplets ejected from the nozzles 122 in the row 174 are parallel to one another resulting in an improved print quality.

Also, as shown in FIG. 24 of the drawings, the substrate 116 has bond pads 176 arranged thereon which provide the electrical connections, via the pads 156, to the actuators 128 of the nozzle assemblies 110. These electrical connections are formed via the CMOS layer (not shown).

Figure 26:
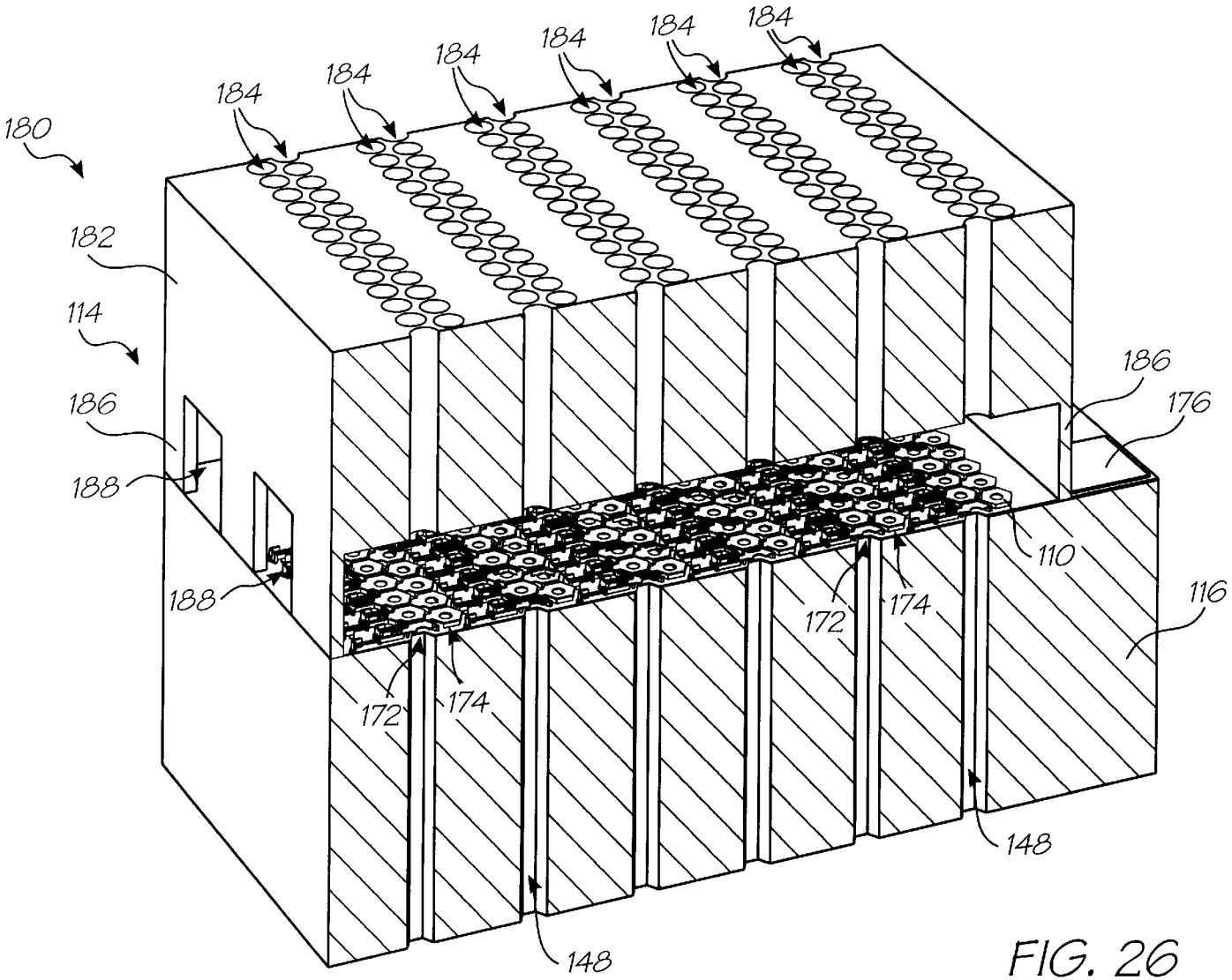
FIG. 26 shows a three dimensional view of an ink jet printhead including a nozzle guard.
Figure 28A:
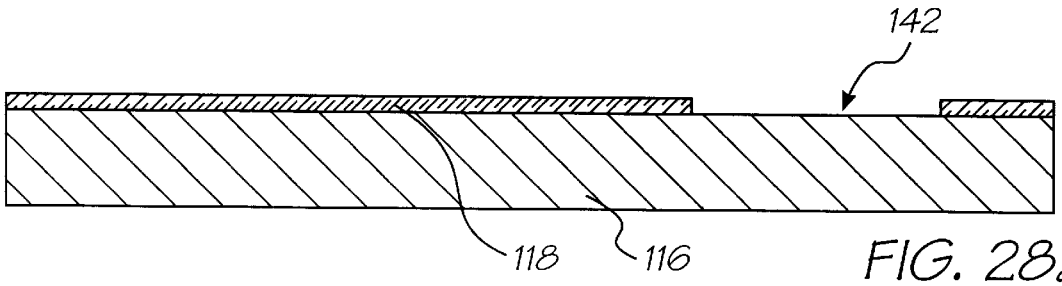
FIGS. 28*a* to 28*r* show sectional side views of the manufacturing steps.
Figure 29A:
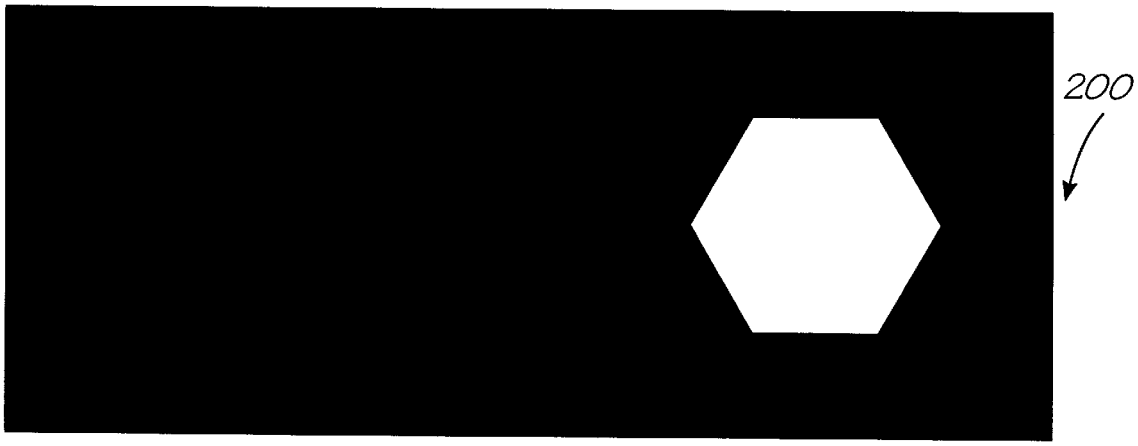
FIGS. 29*a* to 29*k* show layouts of masks used in various steps in the manufacturing process.

Referring to FIG. 26 of the drawings, a development of the invention is shown. With reference to the previous drawings, like reference numerals refer to like parts, unless otherwise specified.

In this development, a nozzle guard 180 is mounted on the substrate 116 of the array 114. The nozzle guard 180 includes a body member 182 having a plurality of passages 184 defined therethrough. The passages 184 are in register with the nozzle openings 124 of the nozzle assemblies 110 of the array 114 such that, when ink is ejected from any one of the nozzle openings 124, the ink passes through the associated passage 184 before striking the print media.

The body member 182 is mounted in spaced relationship relative to the nozzle assemblies 110 by limbs or struts 186. One of the struts 186 has air inlet openings 188 defined therein.

In use, when the array 114 is in operation, air is charged through the inlet openings 188 to be forced through the passages 184 together with ink travelling through the passages 184.

The ink is not entrained in the air as the air is charged through the passages. 184 at a different velocity from that of the ink droplets 164. For example, the ink droplets 164 are ejected from the nozzles 122 at a velocity of approximately 3 m/s. The air is charged through the passages 184 at a velocity of approximately 1 m/s.

The purpose of the air is to maintain the passages 184 clear of foreign particles. A danger exists that these foreign particles, such as dust particles, could fall onto the nozzle assemblies 110 adversely affecting their operation. With the provision of the air inlet openings 88 in the nozzle guard 180 this problem is, to a large extent, obviated.

Referring now to FIGS. 27 to 29 of the drawings, a process for manufacturing the nozzle assemblies 110 is described.

Starting with the silicon substrate or wafer 116, the dielectric layer 118 is deposited on a surface of the wafer 116. The dielectric layer 118 is in the form of approximately 1.5 microns of CVD oxide. Resist is spun on to the layer 118 and the layer 118 is exposed to mask 200 and is subsequently developed.

After being developed, the layer 118 is plasma etched down to the silicon layer 116. The resist is then stripped and the layer 118 is cleaned. This step defines the ink inlet aperture 142.

Figure 27A:
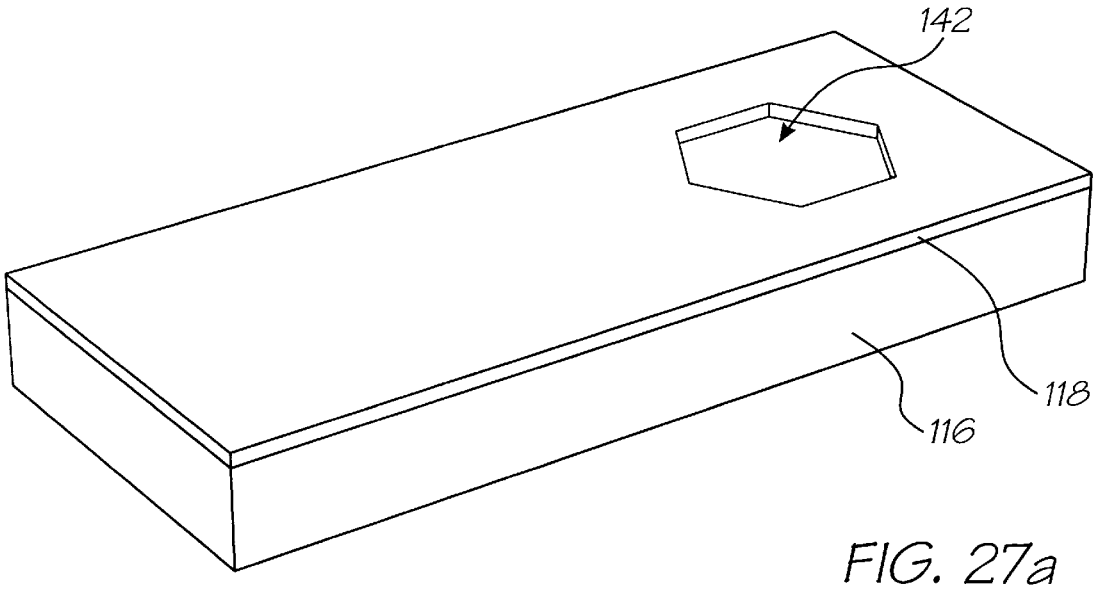
FIGS. 27*a* to 27*r* show three-dimensional views of steps in the manufacture of a nozzle assembly of an ink jet printhead.
Figure 27B:
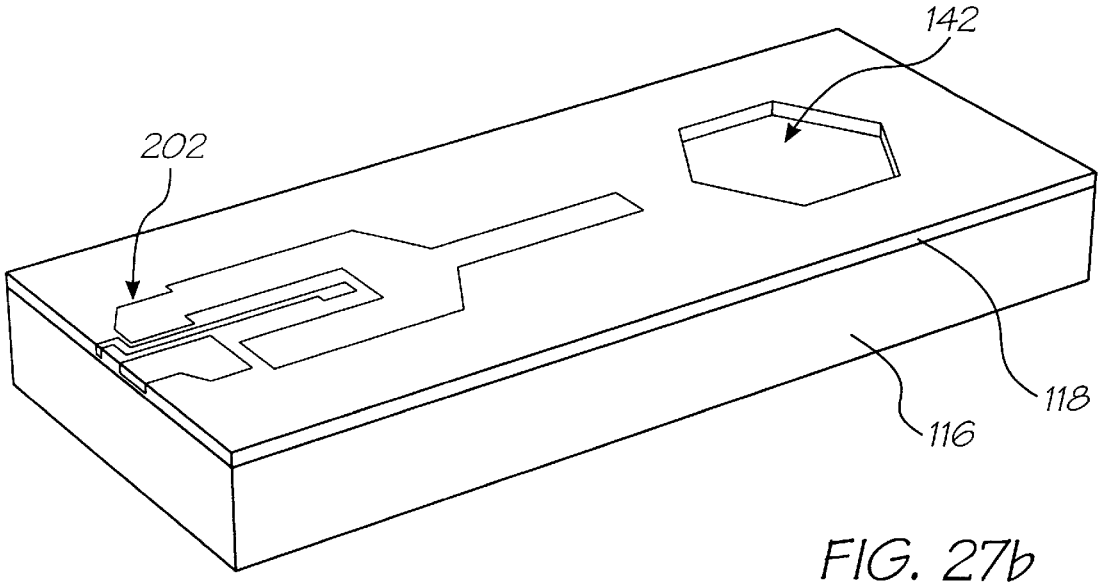
Figure 28B:
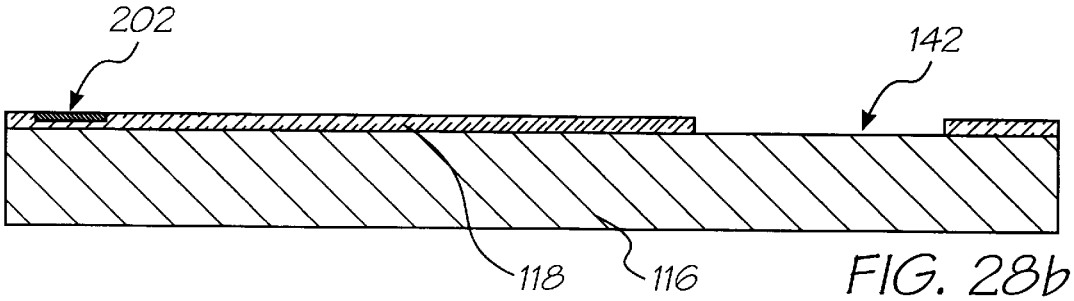
Figure 29B:
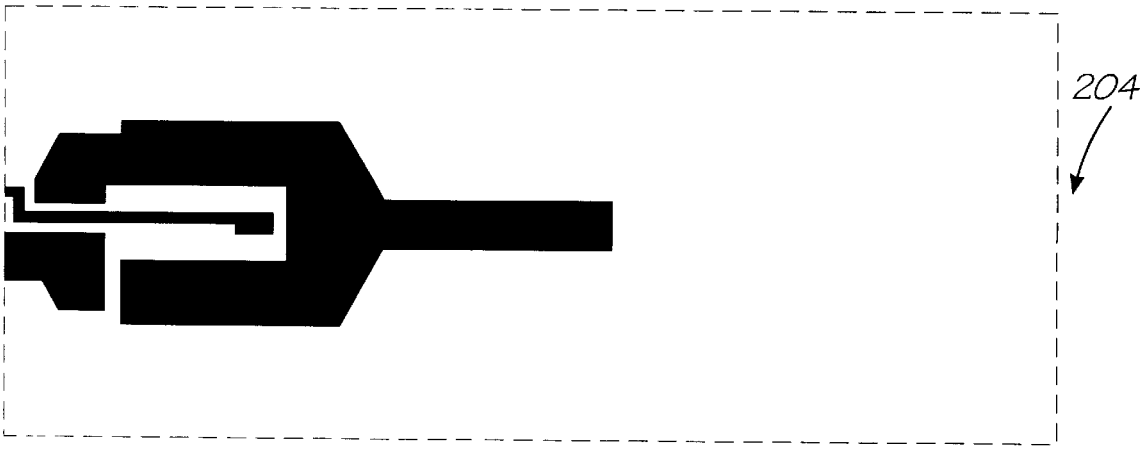
Figure 27C:
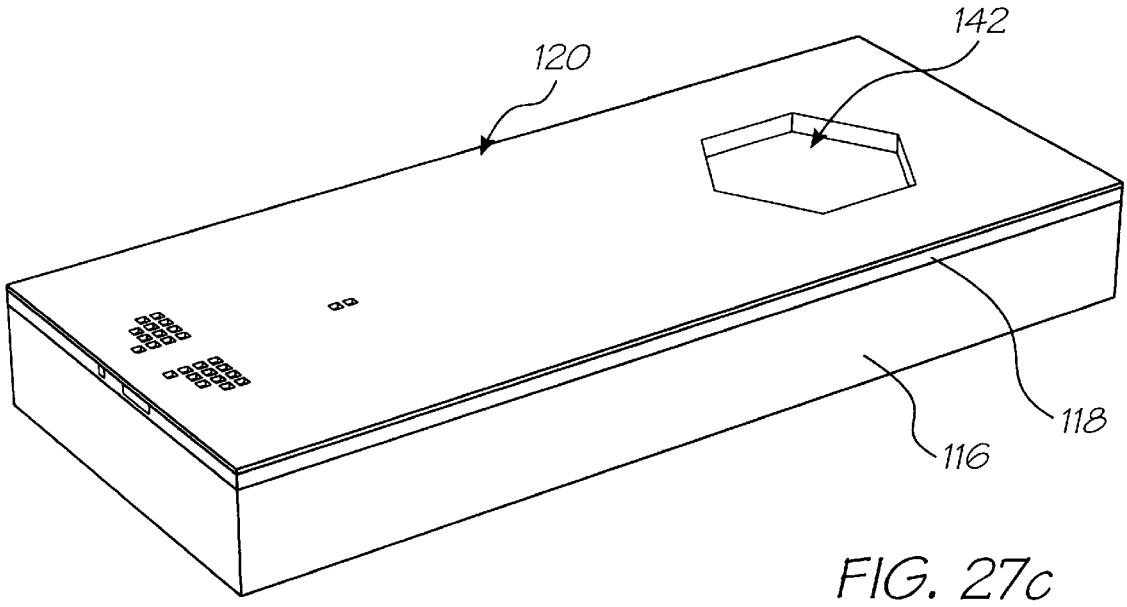
Figure 28C:
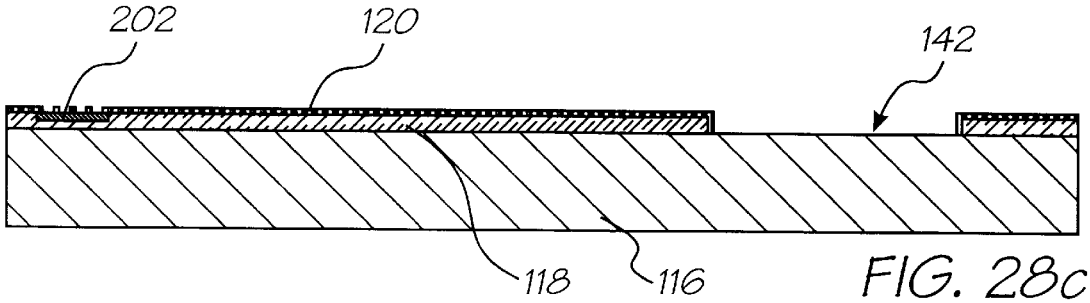
Figure 29C:
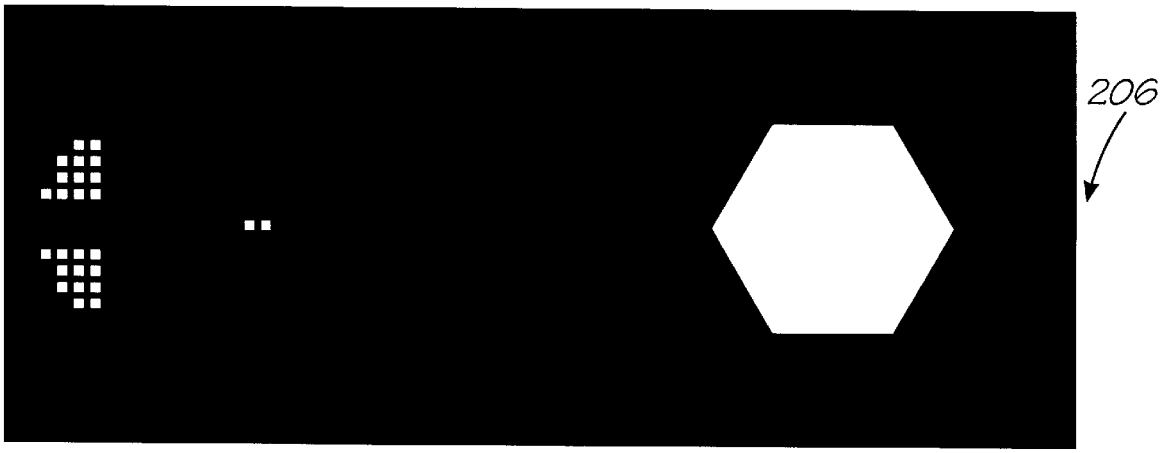
Figure 27D:
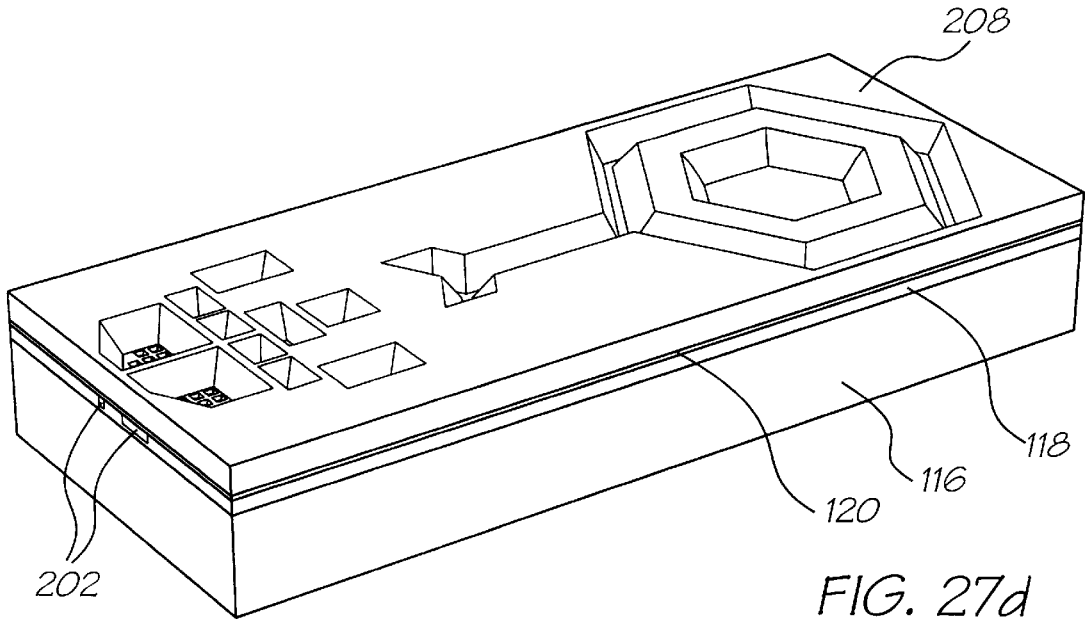
Figure 28D:
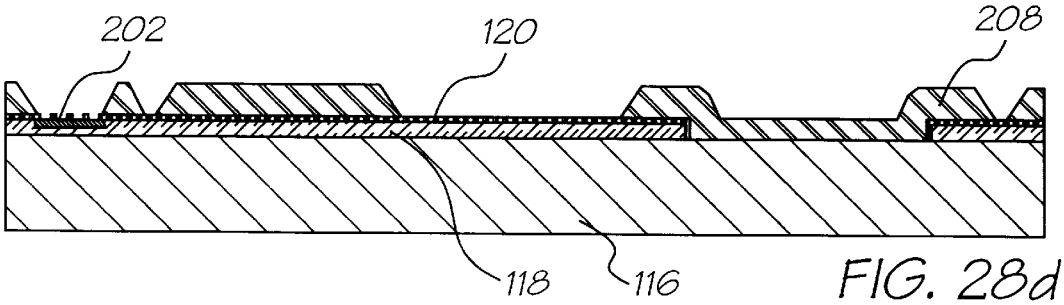
Figure 29D:
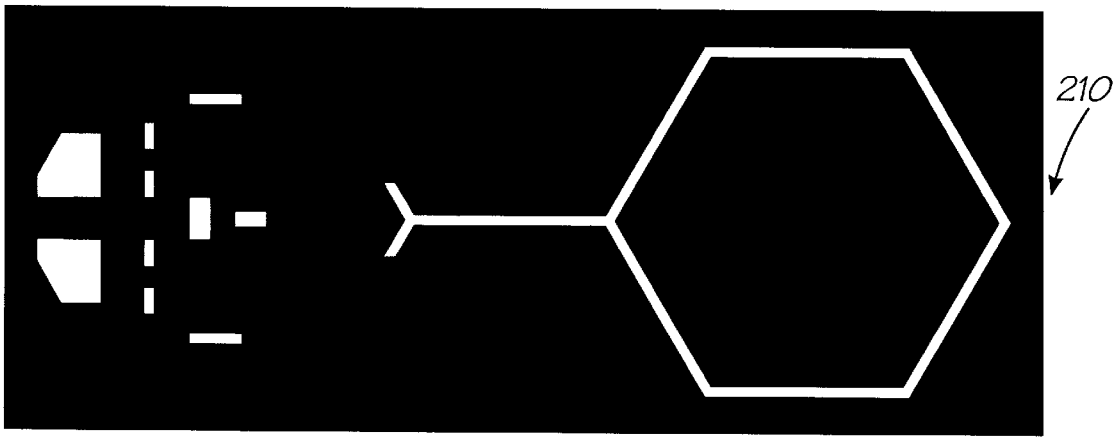

In FIG. 27*b* of the drawings, approximately 0.8 microns of aluminum 202 is deposited on the layer 118. Resist is spun on and the aluminum 202 is exposed to mask 204 and developed. The aluminum 202 is plasma etched down to the oxide layer 118, the resist is stripped and the device is cleaned. This step provides the bond pads and interconnects to the ink jet actuator 128. This interconnect is to an NMOS drive transistor and a power plane with connections made in the CMOS layer (not shown).

Approximately 0.5 microns of PECVD nitride is deposited as the CMOS passivation layer 120. Resist is spun on and the layer 120 is exposed to mask 206 whereafter it is developed. After development, the nitride is plasma etched down to the aluminum layer 202 and the silicon layer 116 in the region of the inlet aperture 142. The resist is stripped and the device cleaned.

A layer 208 of a sacrificial material is spun on to the layer 120. The layer 208 is 6 microns of photo-sensitive polyimide or approximately 4 $\mu$m of high temperature resist. The layer 208 is softbaked and is then exposed to mask 210 whereafter it is developed. The layer 208 is then hardbaked at 400° C. for one hour where the layer 208 is comprised of polyimide or at greater than 300° C. where the layer 208 is high temperature resist. It is to be noted in the drawings that the pattern-dependent distortion of the polyimide layer 208 caused by shrinkage is taken into account in the design of the mask 210.

Figure 27E:
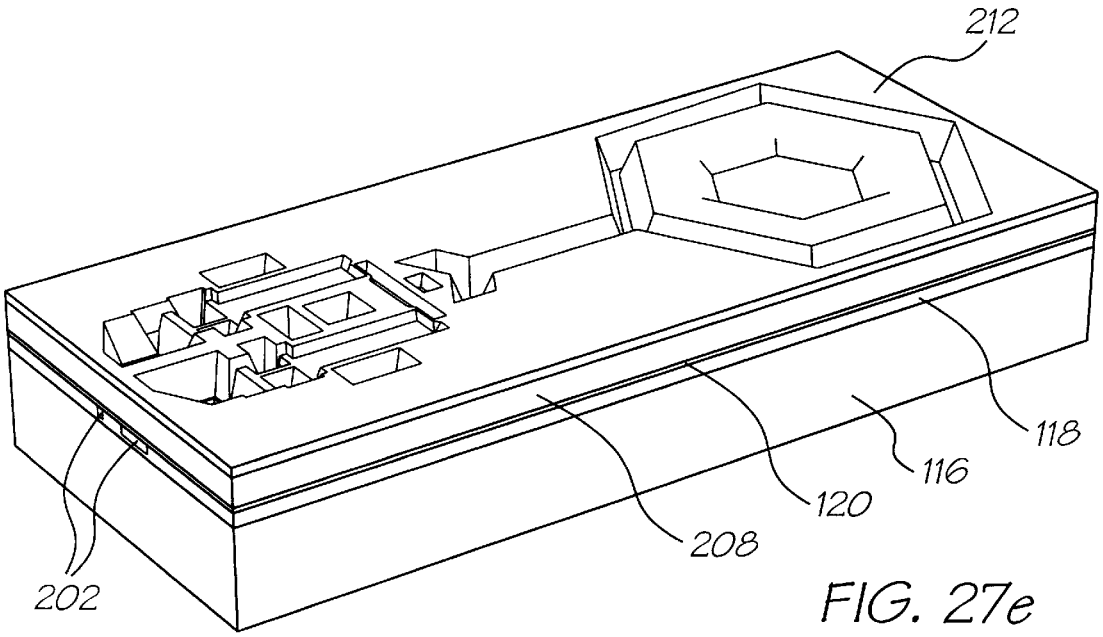
Figure 28E:
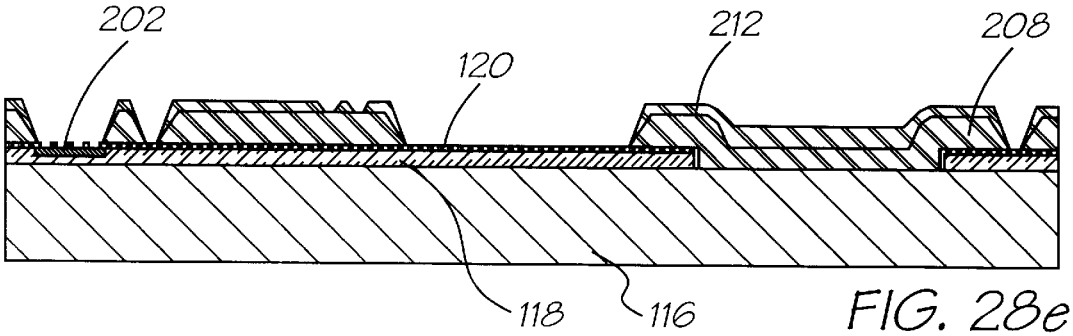
Figure 29E:
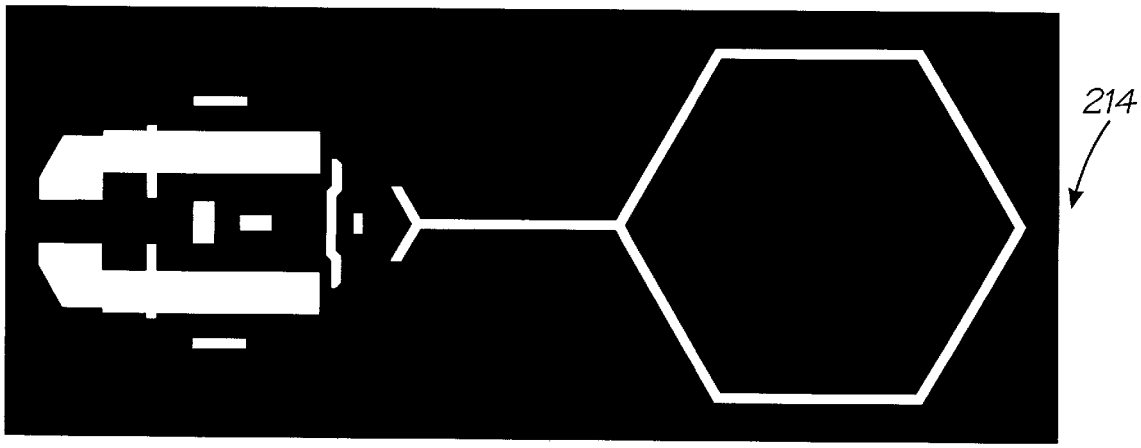
Figure 27F:
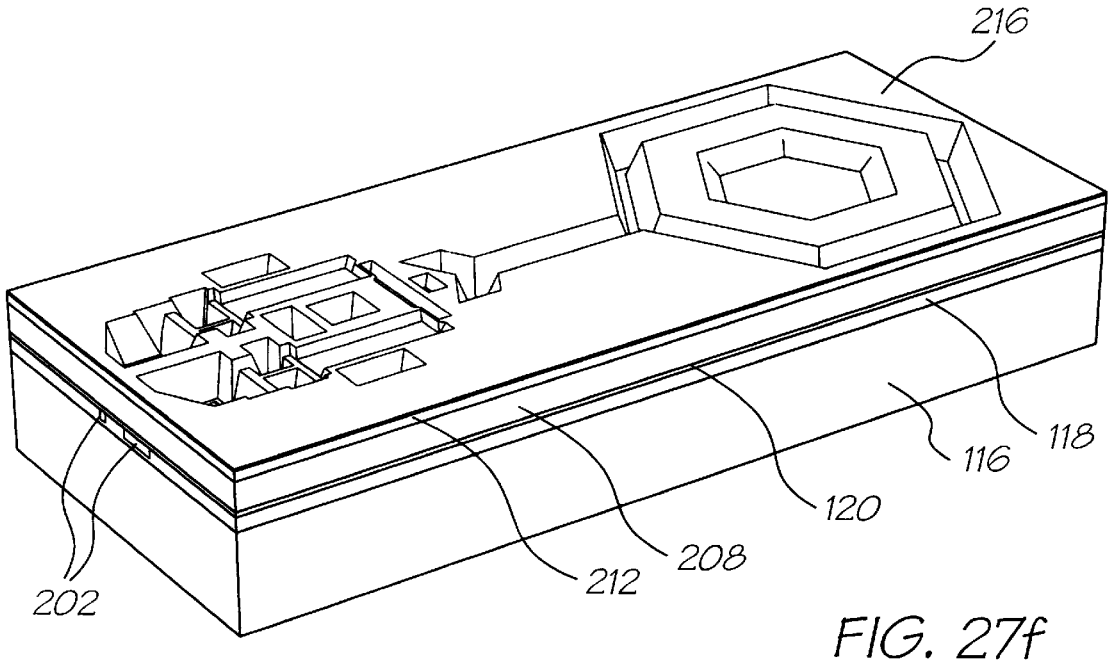
Figure 28F:
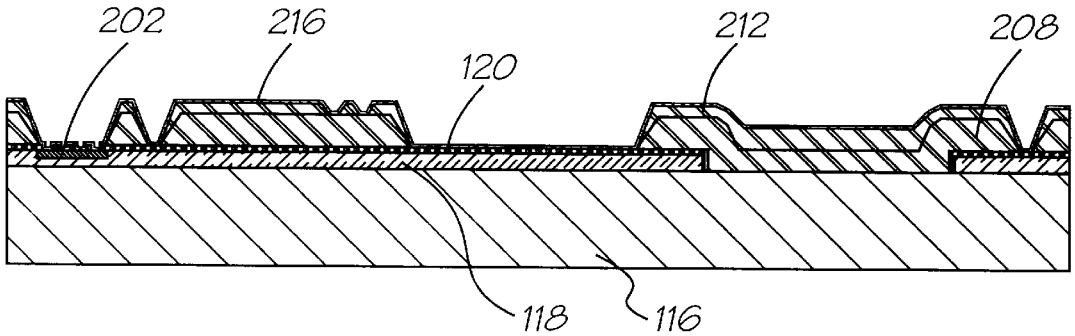
Figure 27G:
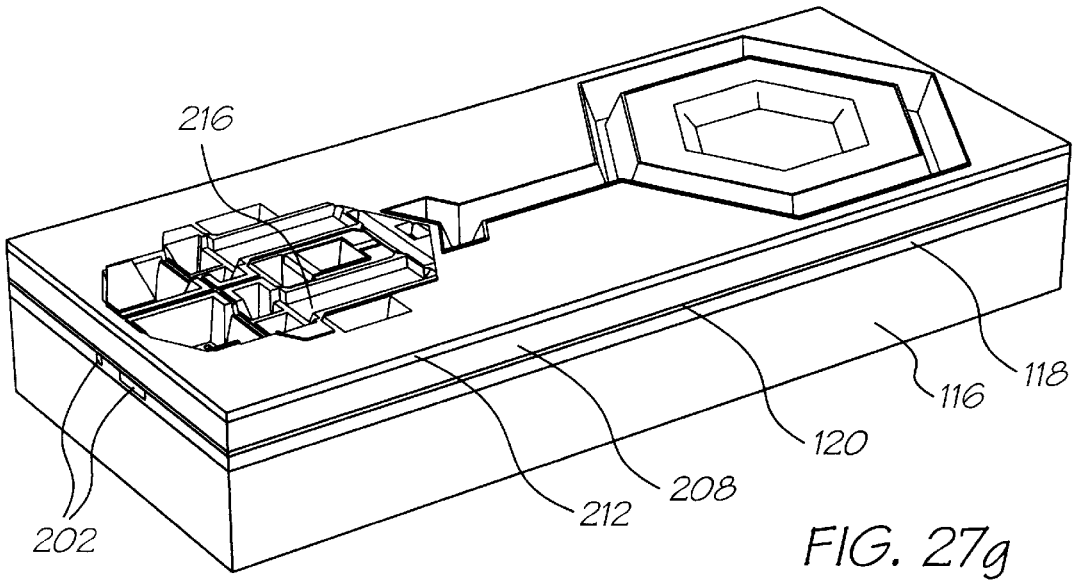
Figure 28G:
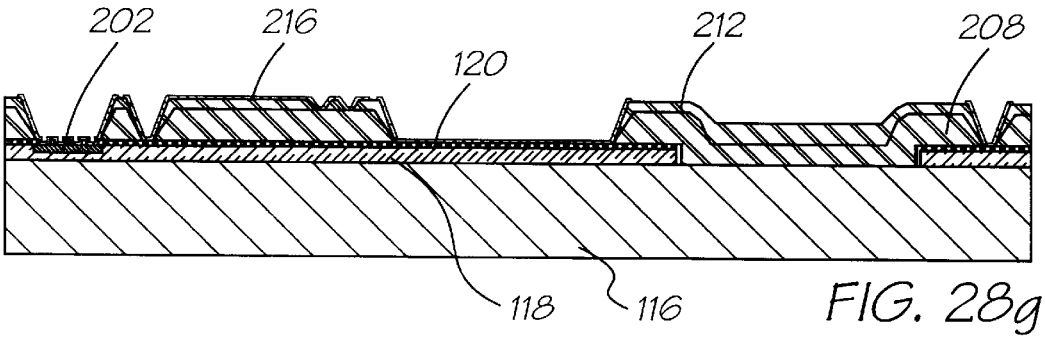
Figure 29F:
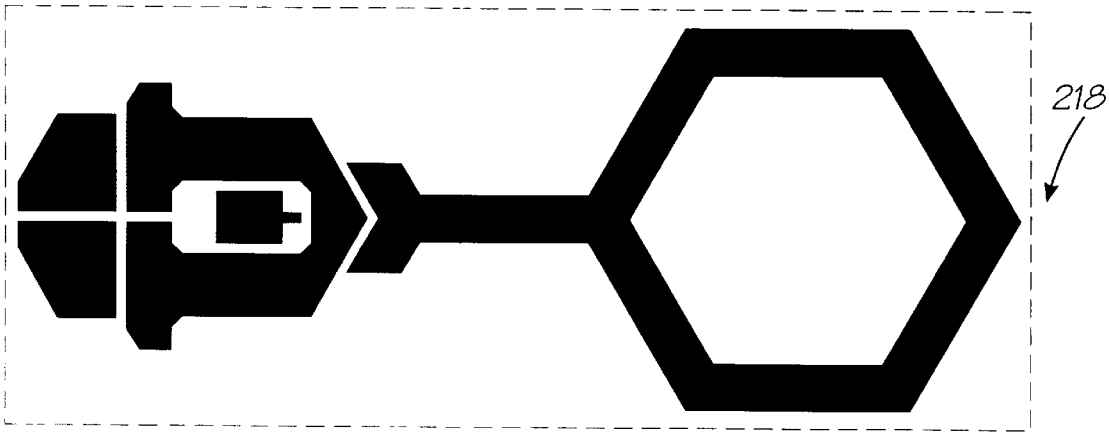
Figure 27H:
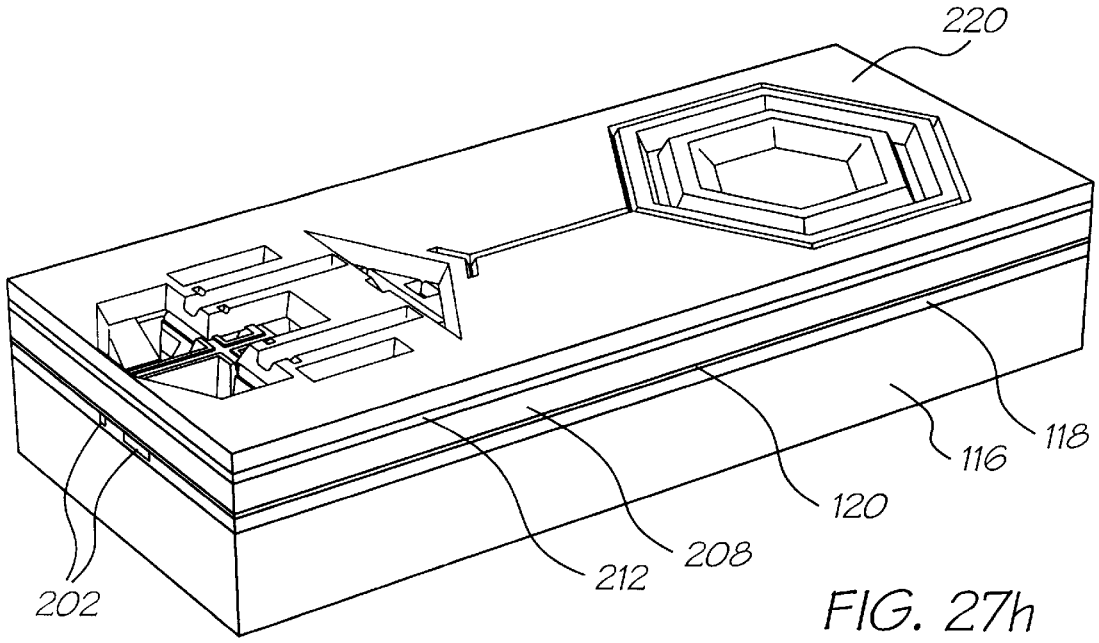
Figure 28H:
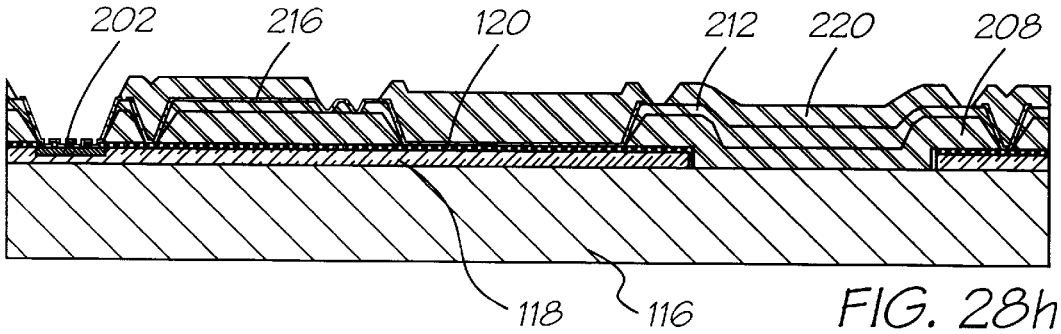
Figure 29G:
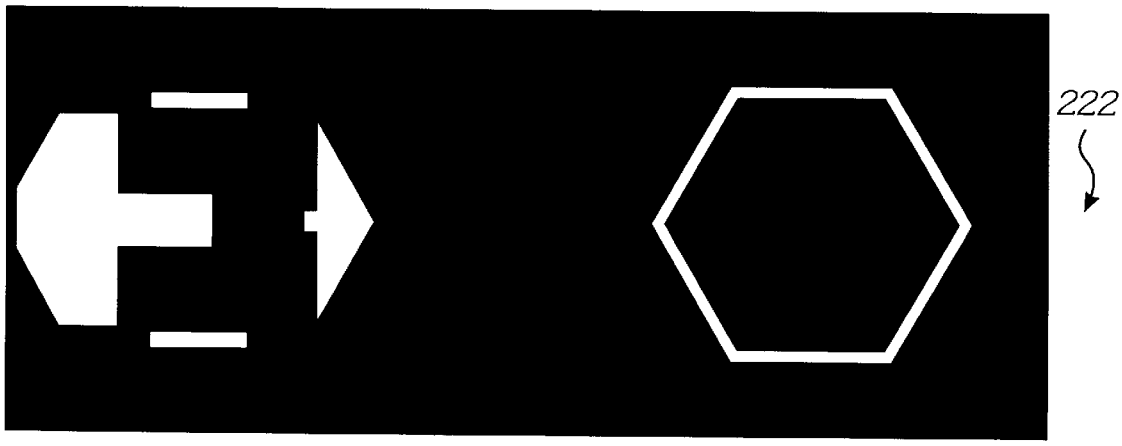
Figure 27I:
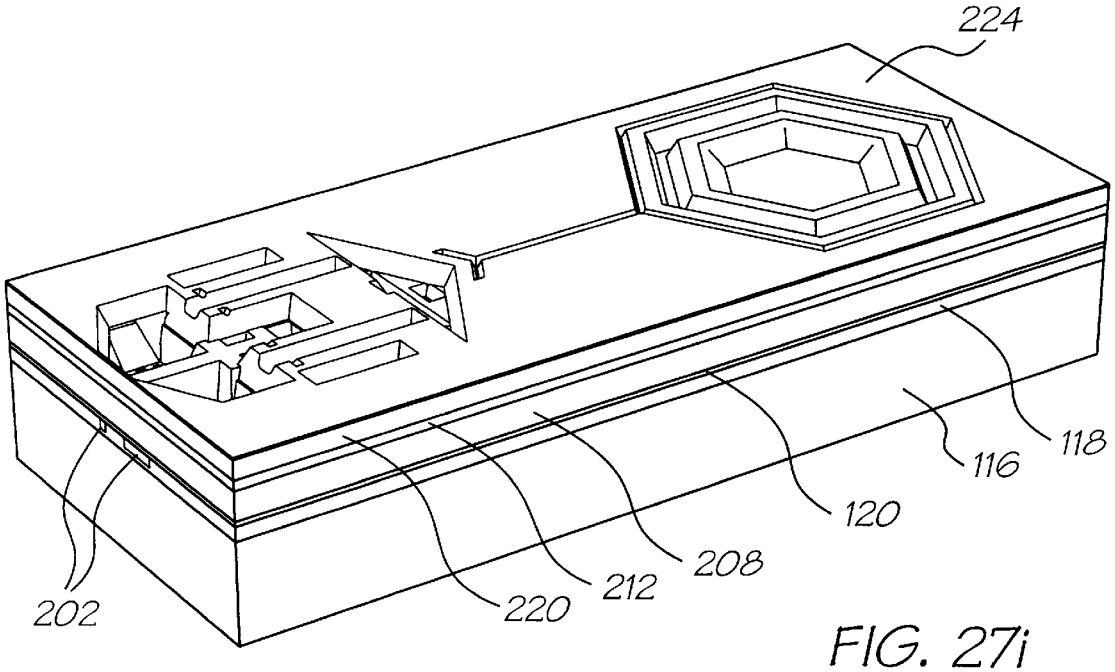
Figure 28I:
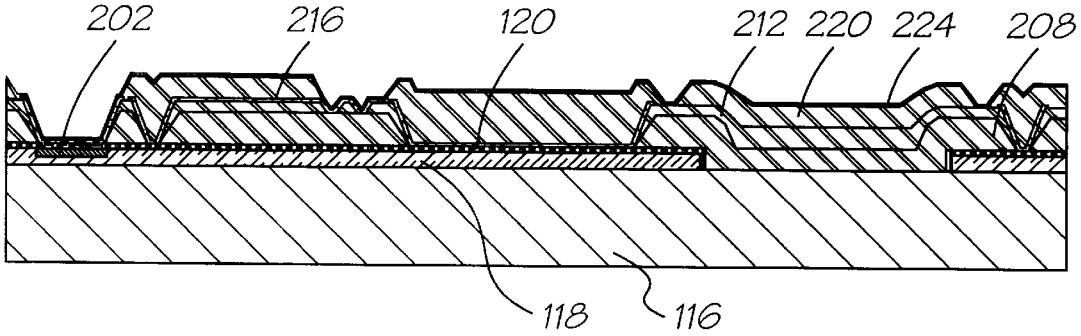
Figure 27J:
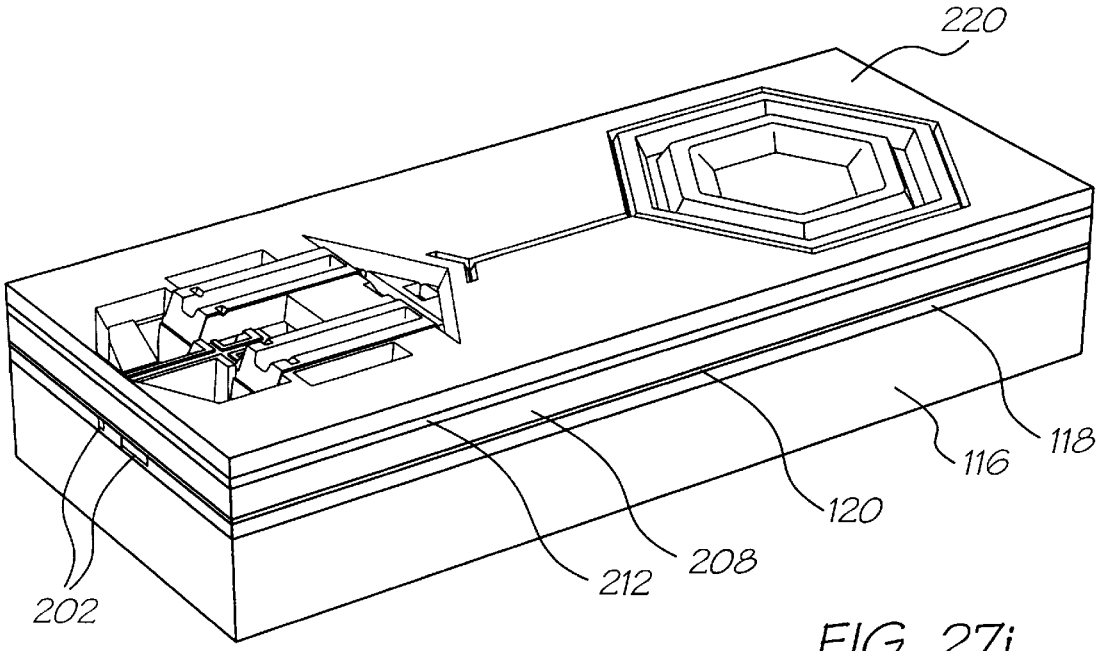
Figure 28J:
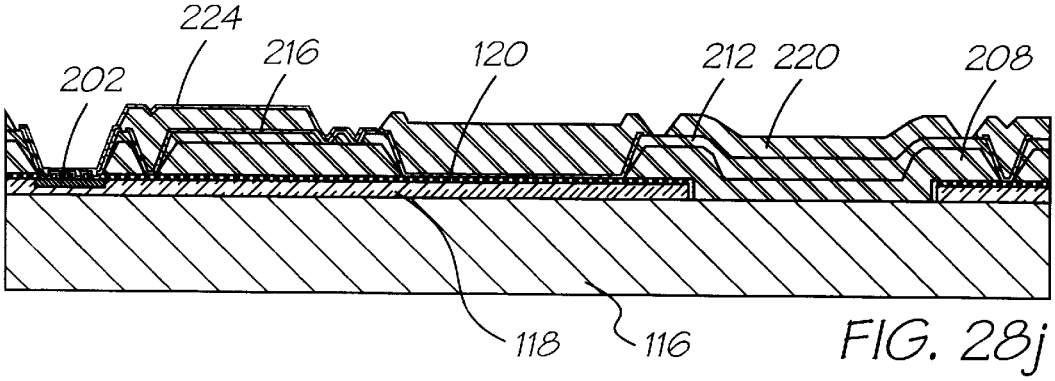
Figure 29H:
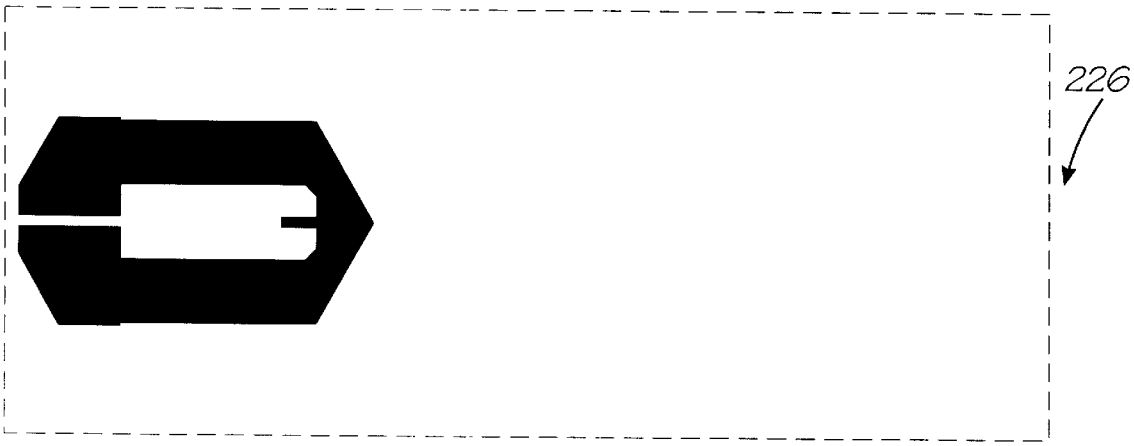
Figure 27K:
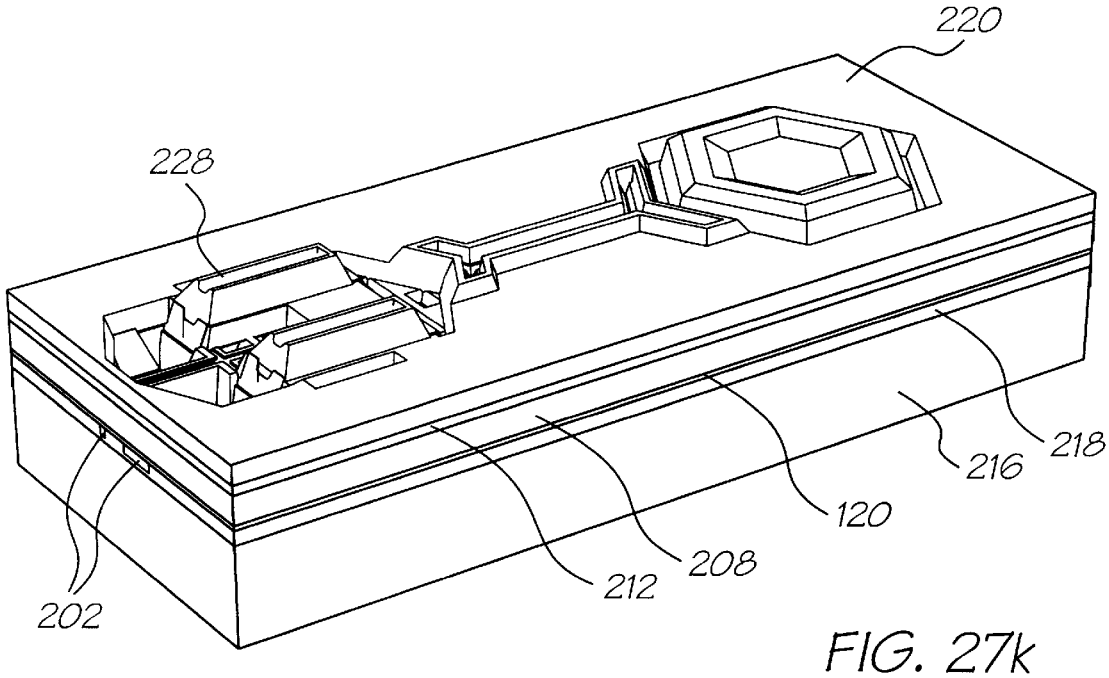
Figure 28K:
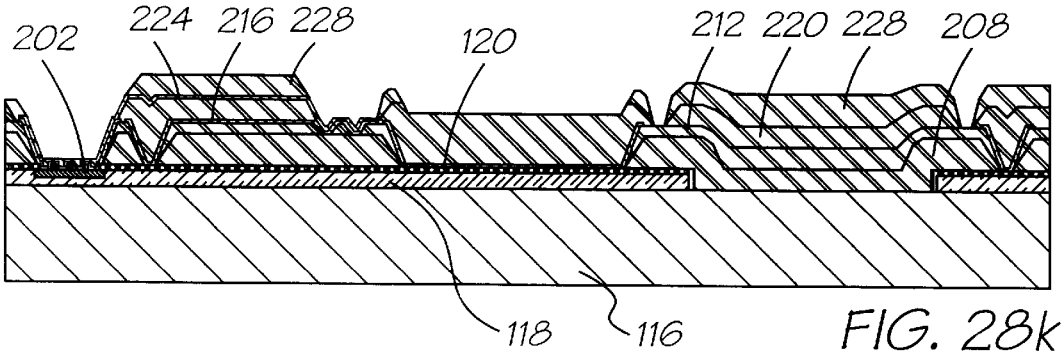
Figure 29I:
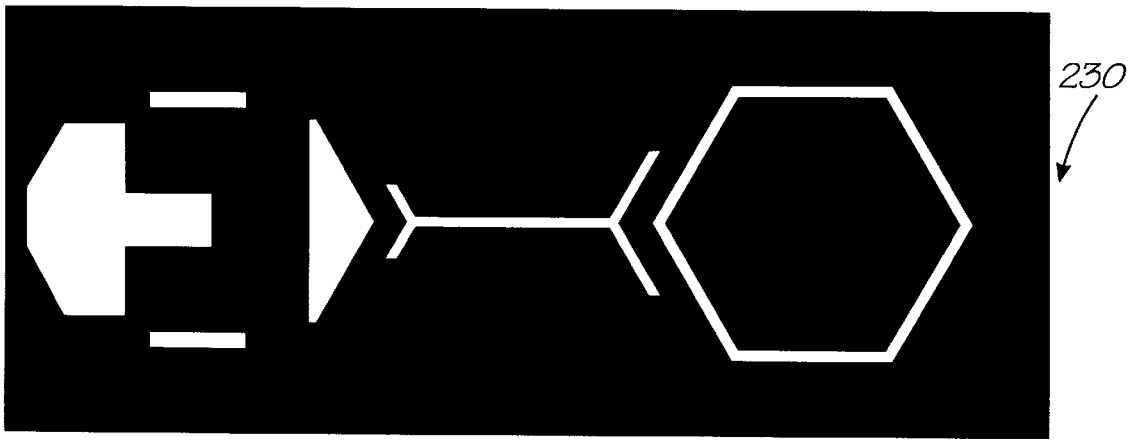

In the next step, shown in FIG. 27*e* of the drawings, a second sacrificial layer 212 is applied. The layer 212 is either 2 $\mu$m of photo-sensitive polyimide which is spun on or approximately 1.3 m of high temperature resist. The layer 212 is softbaked and exposed to mask 214. After exposure to the mask 214, the layer 212 is developed. In the case of the layer 212 being polyimide, the layer 212 is hardbaked at 400° C. for approximately one hour. Where the layer 212 is resist, it is hardbaked at greater than 300° C. for approximately one hour.

A 0.2 micron multi-layer metal layer 216 is then deposited. Part of this layer 216 forms the passive beam 160 of the actuator 128.

The layer 216 is formed by sputtering 1,000 Å of titanium nitride (TiN) at around 300° C. followed by sputtering 50 Å of tantalum nitride (TaN). A further 1,000 Å of TiN is sputtered on followed by 50 Å of TaN and a further 1,000 Å of TiN.

Other materials which can be used instead of TiN are $TiB_2$, $MoSi_2$ or (Ti, Al)N.

The layer 216 is then exposed to mask 218, developed and plasma etched down to the layer 212 whereafter resist, applied for the layer 216, is wet stripped taking care not to remove the cured layers 208 or 212.

A third sacrificial layer 220 is applied by spinning on 4 $\mu$m of photo-sensitive polyimide or approximately 2.6 $\mu$m high temperature resist. The layer 220 is softbaked whereafter it is exposed to mask 222. The exposed layer is then developed followed by hardbaking. In the case of polyimide, the layer 220 is hardbaked at 400° C. for approximately one hour or at greater than 300° C. where the layer 220 comprises resist.

A second multi-layer metal layer 224 is applied to the layer 220. The constituents of the layer 224 are the same as the layer 216 and are applied in the same manner. It will be appreciated that both layers 216 and 224 are electrically conductive layers.

The layer 224 is exposed to mask 226 and is then developed. The layer 224 is plasma etched down to the polyimide or resist layer 220 whereafter resist applied for the layer 224 is wet stripped taking care not to remove the cured layers 208, 212 or 220. It will be noted that the remaining part of the layer 224 defines the active beam 158 of the actuator 128.

A fourth sacrificial layer 228 is applied by spinning on 4 $\mu$m of photo-sensitive polyimide or approximately 2.6 $\mu$m of high temperature resist. The layer 228 is softbaked, exposed to the mask 230 and is then developed to leave the island portions as shown in FIG. 9*k* of the drawings. The remaining portions of the layer 228 are hardbaked at 400° C. for approximately one hour in the case of polyimide or at greater than 300° C. for resist.

Figure 271:
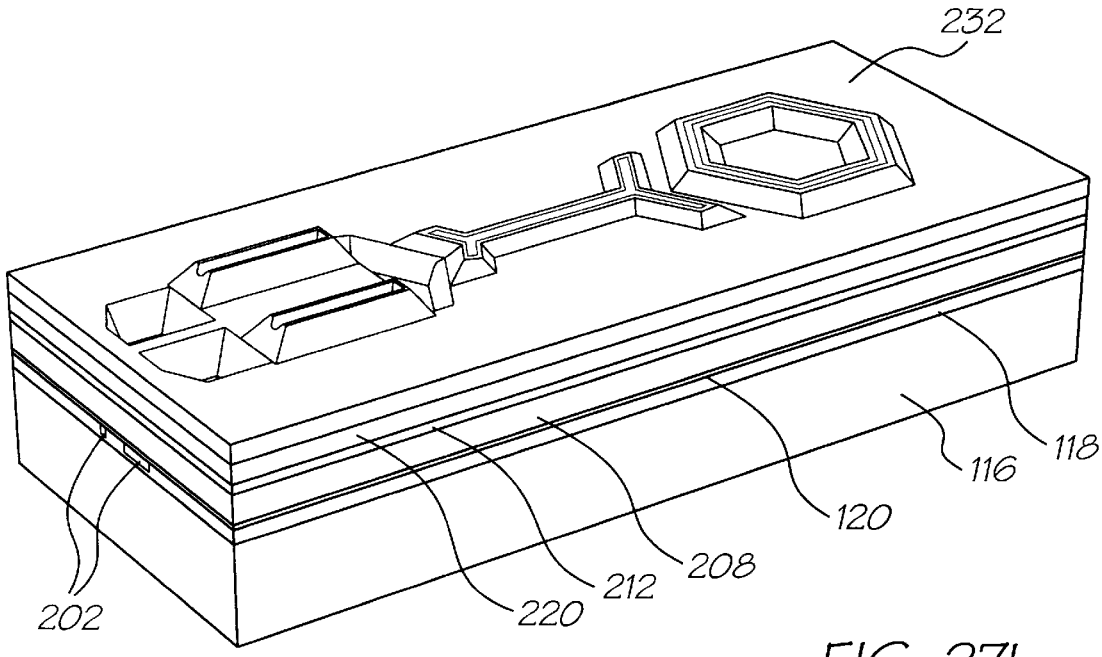
Figure 281:
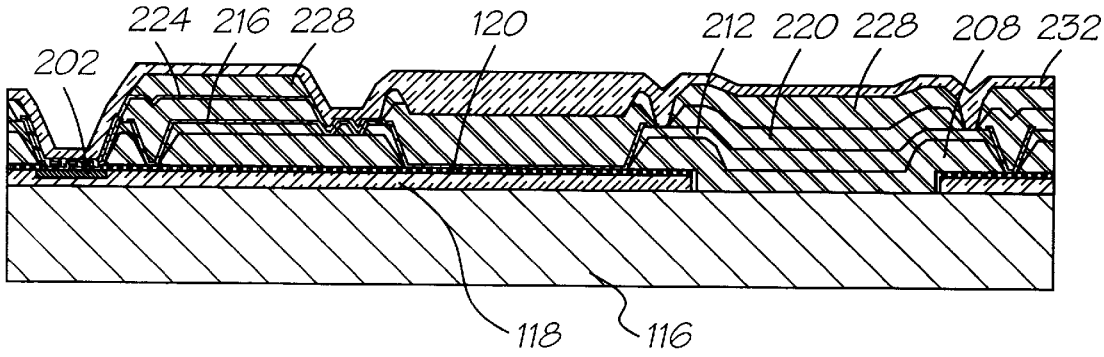
Figure 28M:
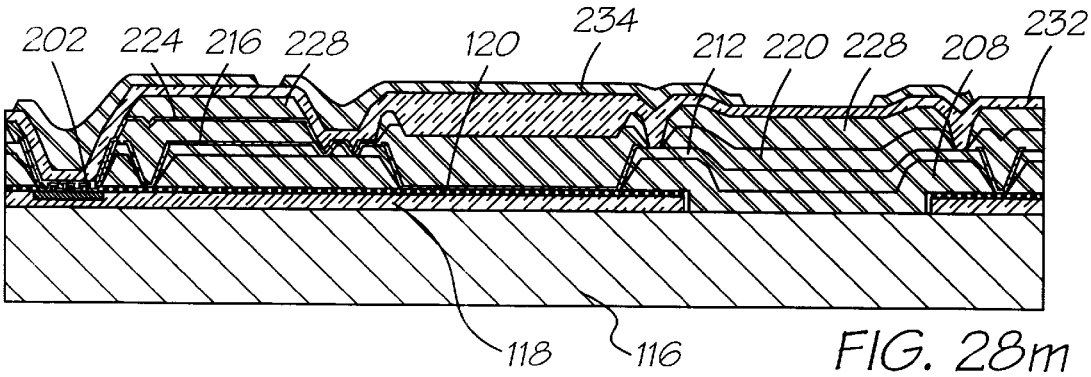
Figure 29J:
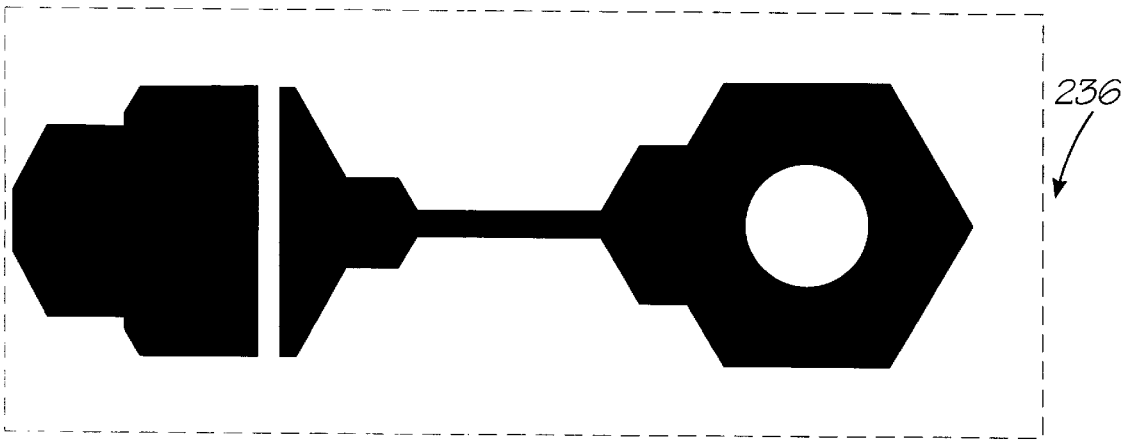
Figure 28N:
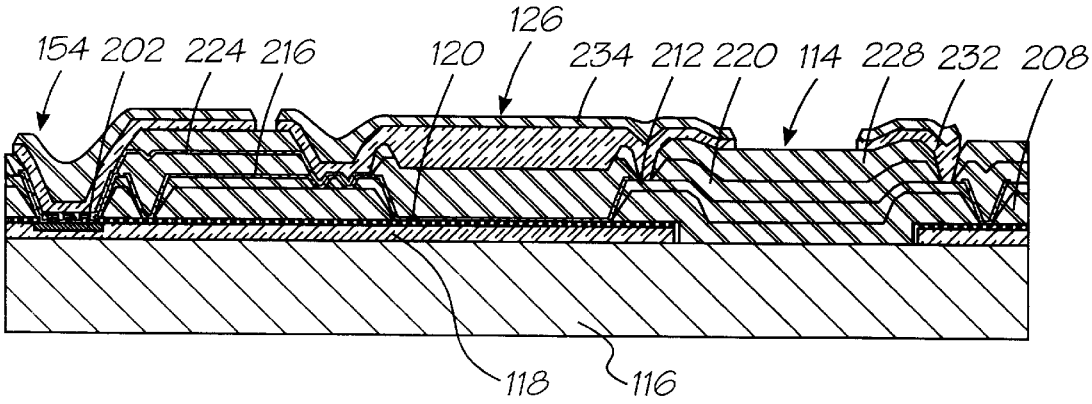
Figure 28O:
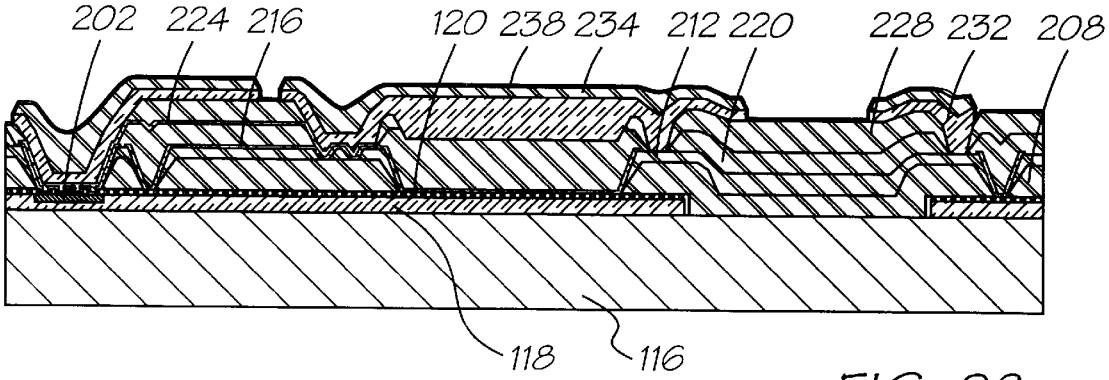

As shown in FIG. 271 of the drawing a high Young's modulus dielectric layer 232 is deposited. The layer 232 is constituted by approximately 1 $\mu$m of silicon nitride or aluminum oxide. The layer 232 is deposited at a temperature below the hardbaked temperature of the sacrificial layers 208, 212, 220, 228. The primary characteristics required for this dielectric layer 232 are a high elastic modulus, chemical inertness and good adhesion to TiN.

A fifth sacrificial layer 234 is applied by spinning on 2 $\mu$m of photo-sensitive polyimide or approximately 1.3 $\mu$m of high temperature resist. The layer 234 is softbaked, exposed to mask 236 and developed. The remaining portion of the layer 234 is then hardbaked at 400° C. for one hour in the case of the polyimide or at greater than 300° C. for the resist.

The dielectric layer 232 is plasma etched down to the sacrificial layer 228 taking care not to remove any of the sacrificial layer 234.

This step defines the nozzle opening 124, the lever arm 126 and the anchor 154 of the nozzle assembly 110.

A high Young's modulus dielectric layer 238 is deposited. This layer 238 is formed by depositing 0.2 μm of silicon nitride or aluminum nitride at a temperature below the hardbaked temperature of the sacrificial layers 208, 212, 220 and 228.

Figure 27M:
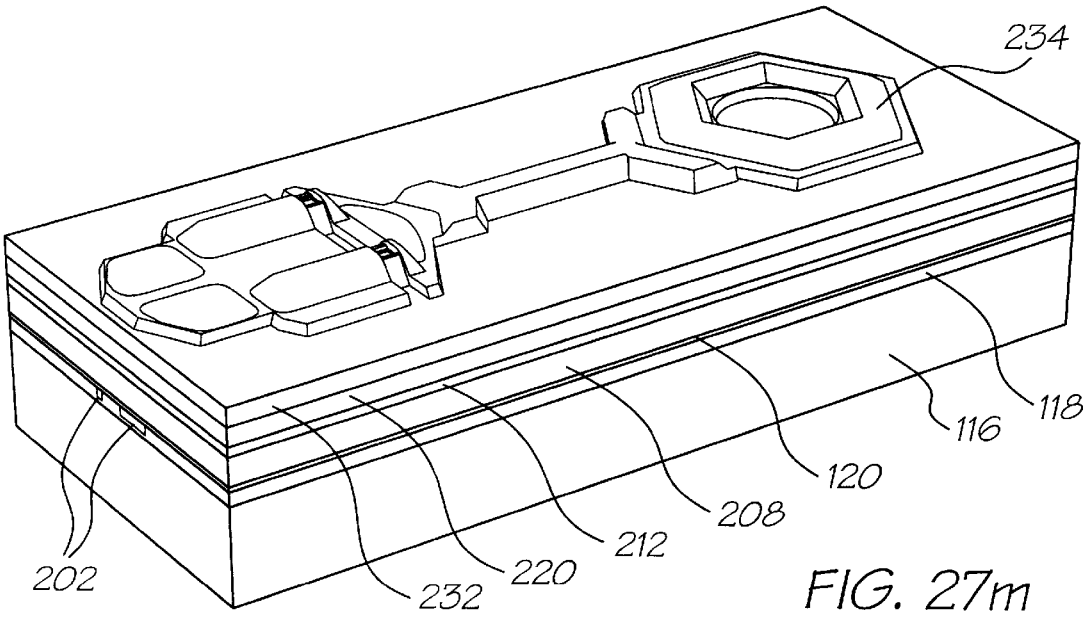
Figure 27N:
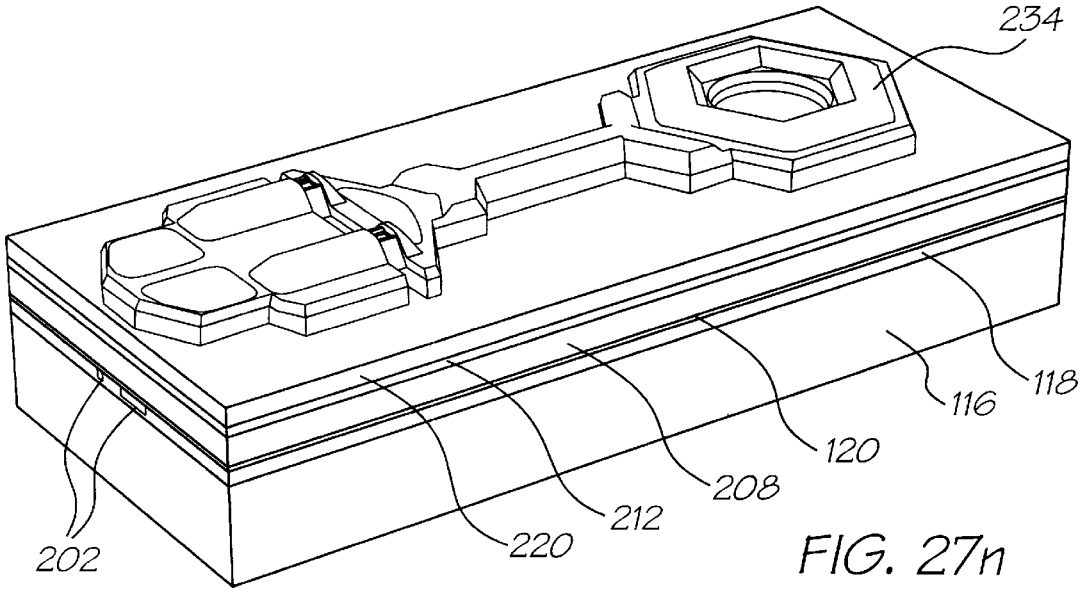
Figure 27O:
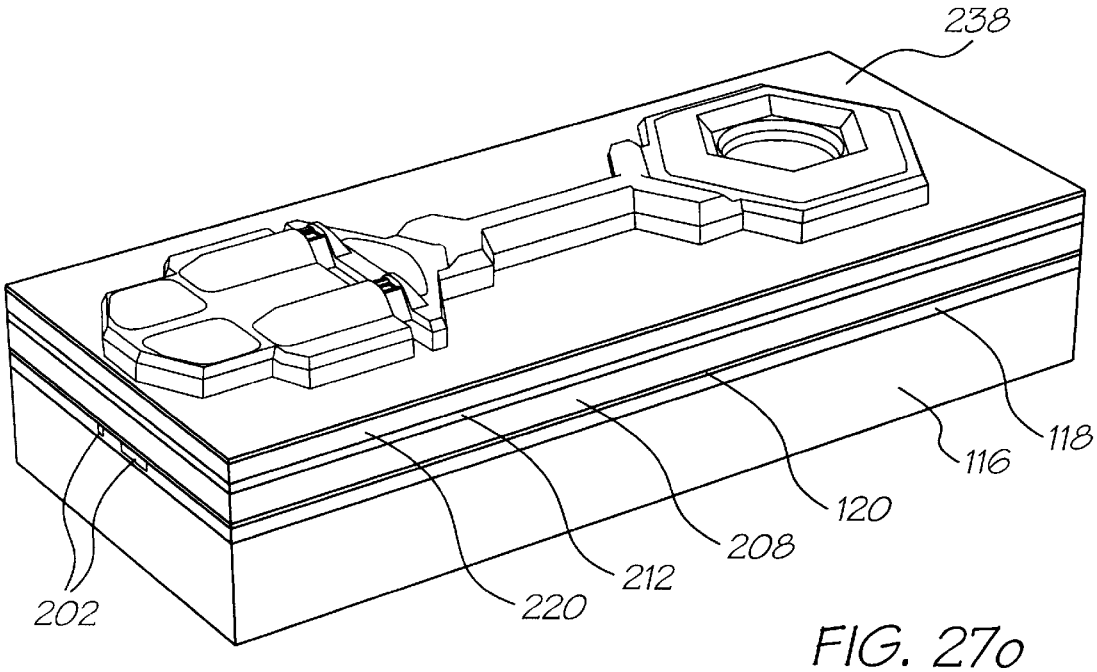
Figure 27P:
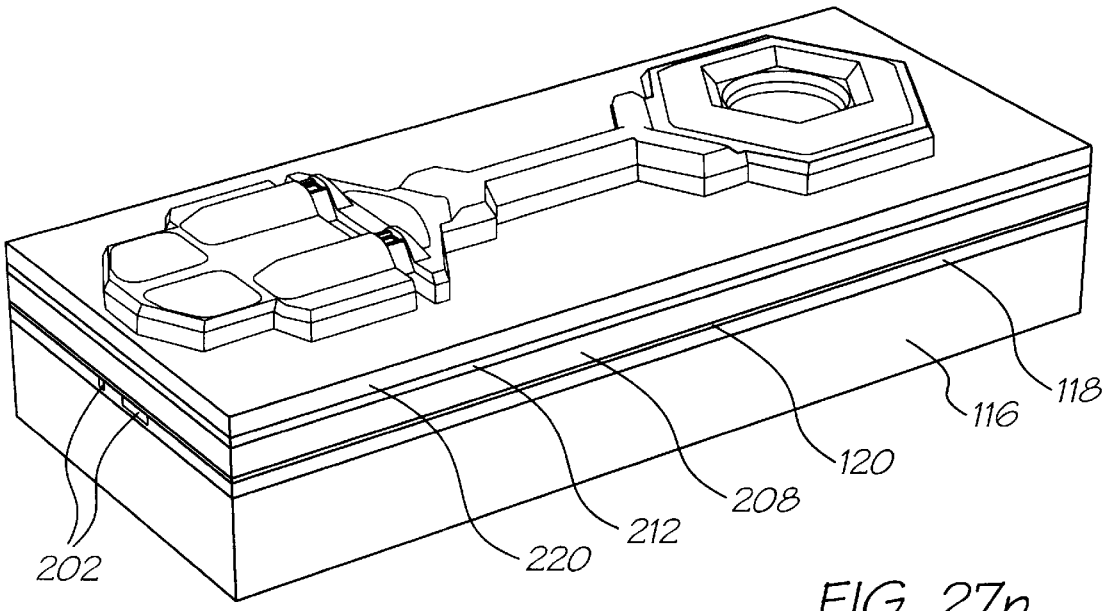
Figure 28P:
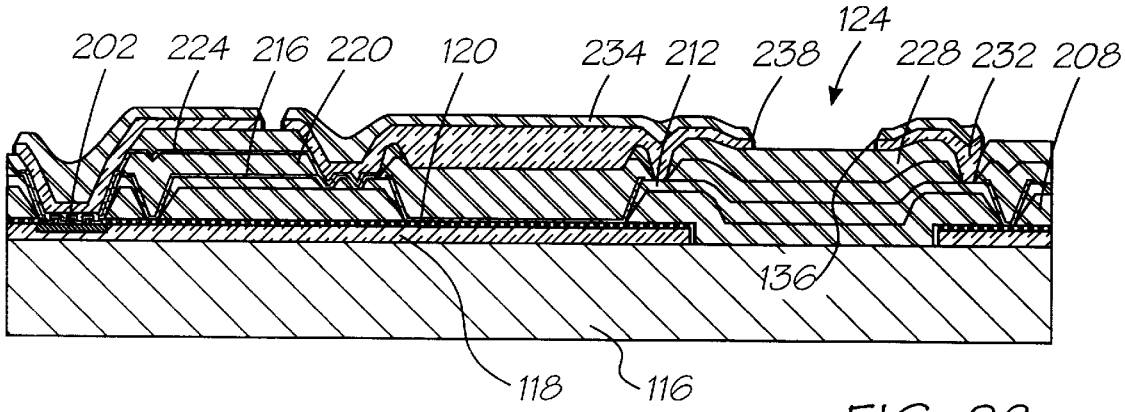
Figure 27Q:
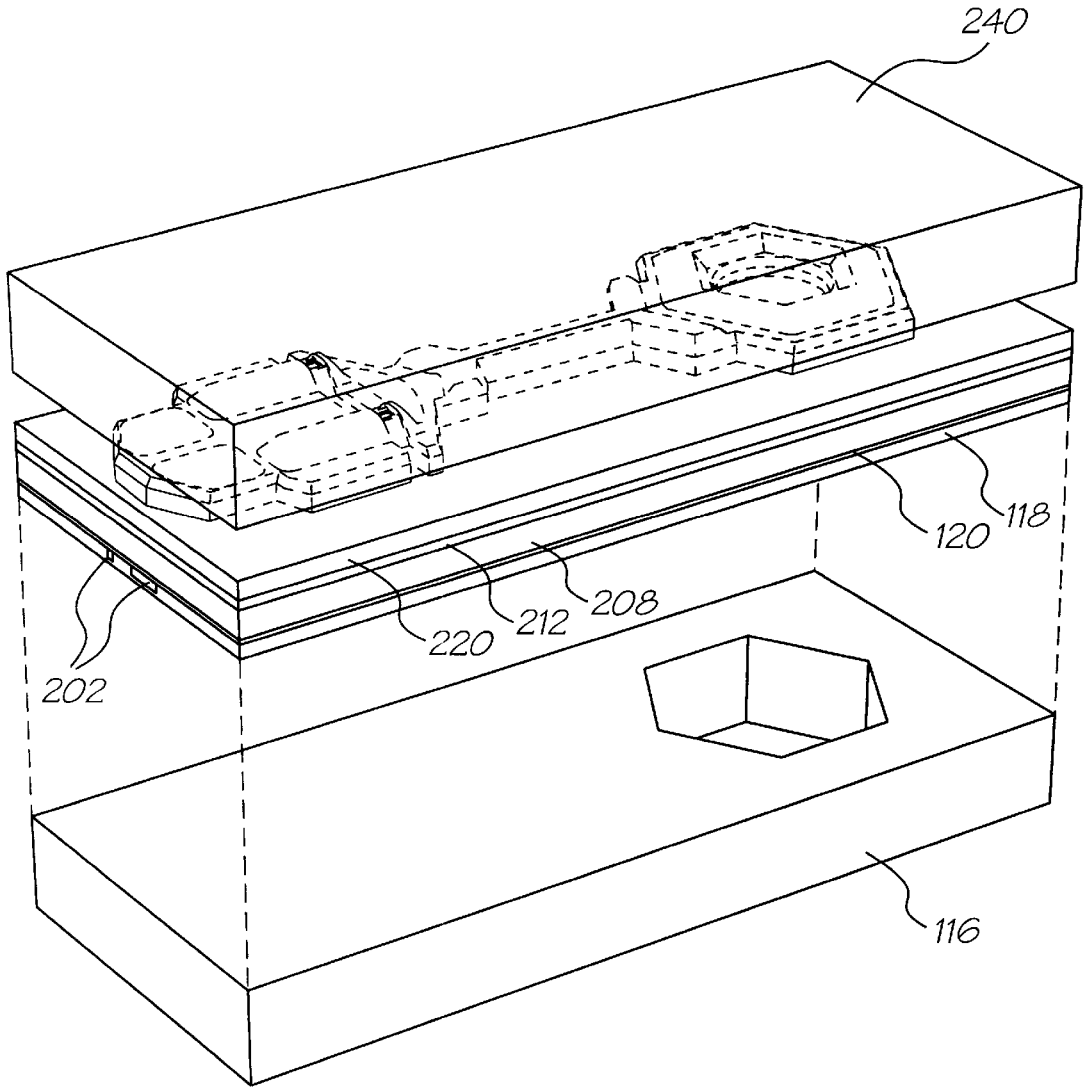
Figure 28Q:
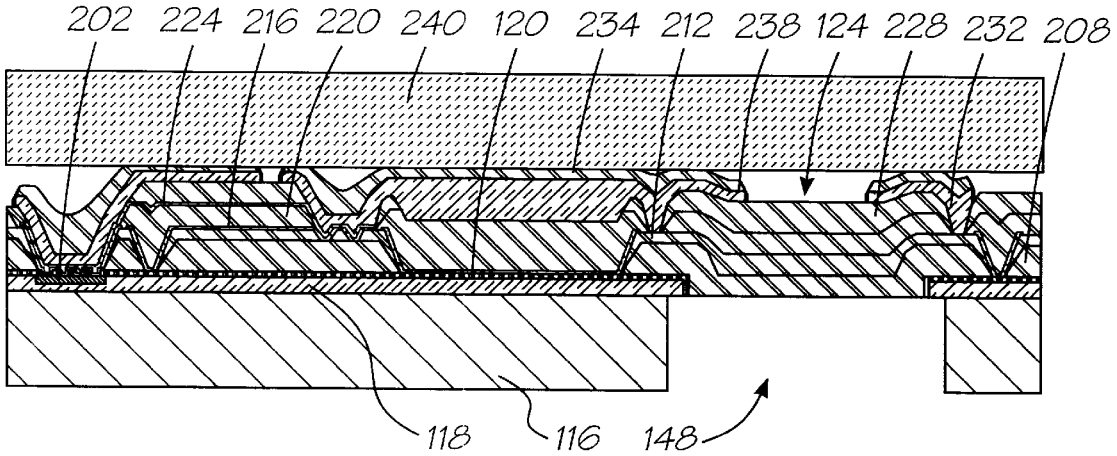
Figure 29K:
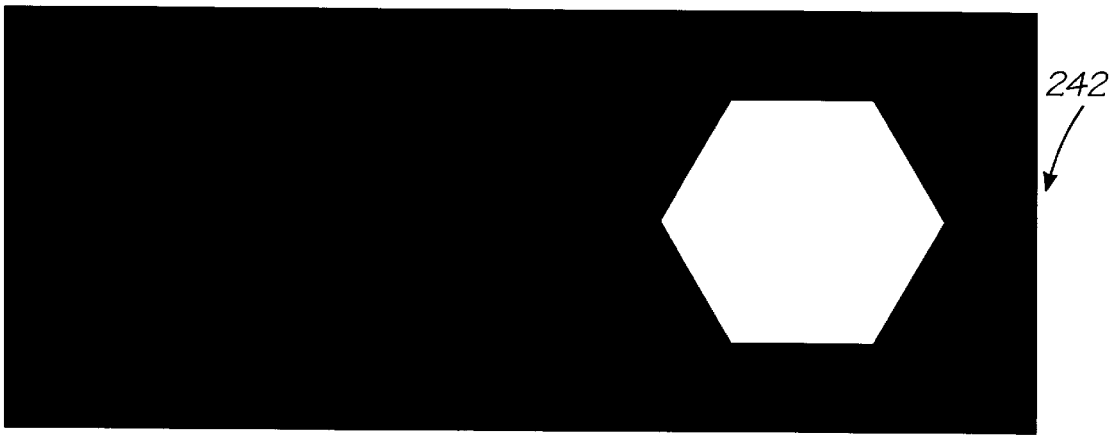

Then, as shown in FIG. 27*p* of the drawings, the layer 238 is anisotropically plasma etched to a depth of 0.35 microns. This etch is intended to clear the dielectric from all of the surface except the side walls of the dielectric layer 232 and the sacrificial layer 234. This step creates the nozzle rim 136 around the nozzle opening 124 which "pins" the meniscus of ink, as described above.

An ultraviolet (UV) release tape 240 is applied. 4 μm of resist is spun on to a rear of the silicon wafer 116. The wafer 116 is exposed to mask 242 to back etch the wafer 116 to define the ink inlet channel 148. The resist is then stripped from the wafer 116.

Figure 27R:
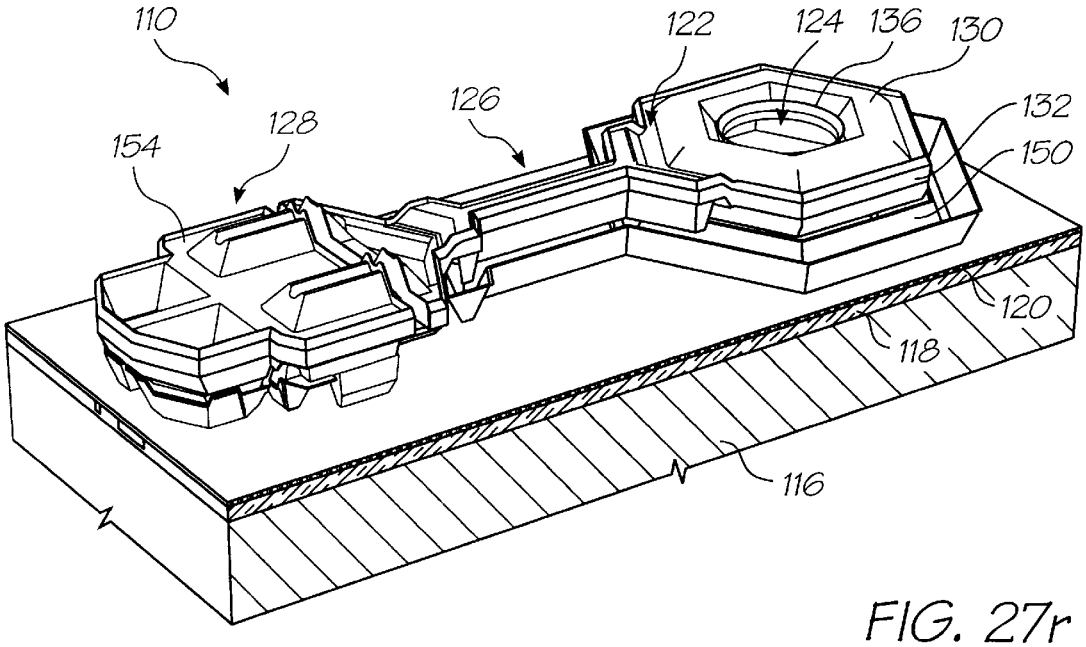
Figure 28R:
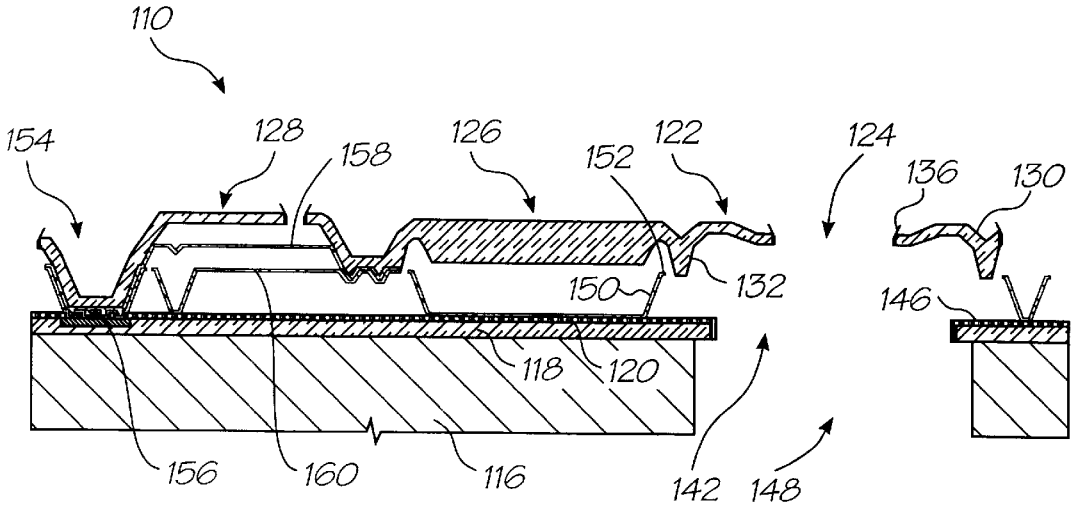
Figure 30A:
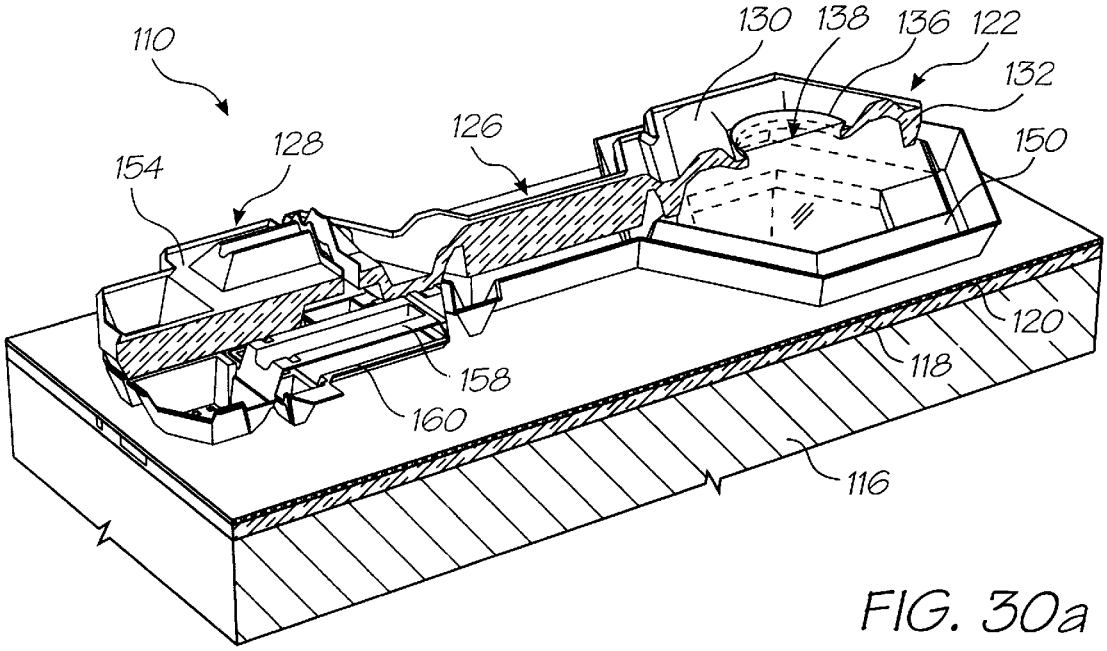
FIGS. 30*a* to 30*c* show three dimensional views of an operation of the nozzle assembly manufactured according to the method of FIGS. 27 and 28.
Figure 30B:
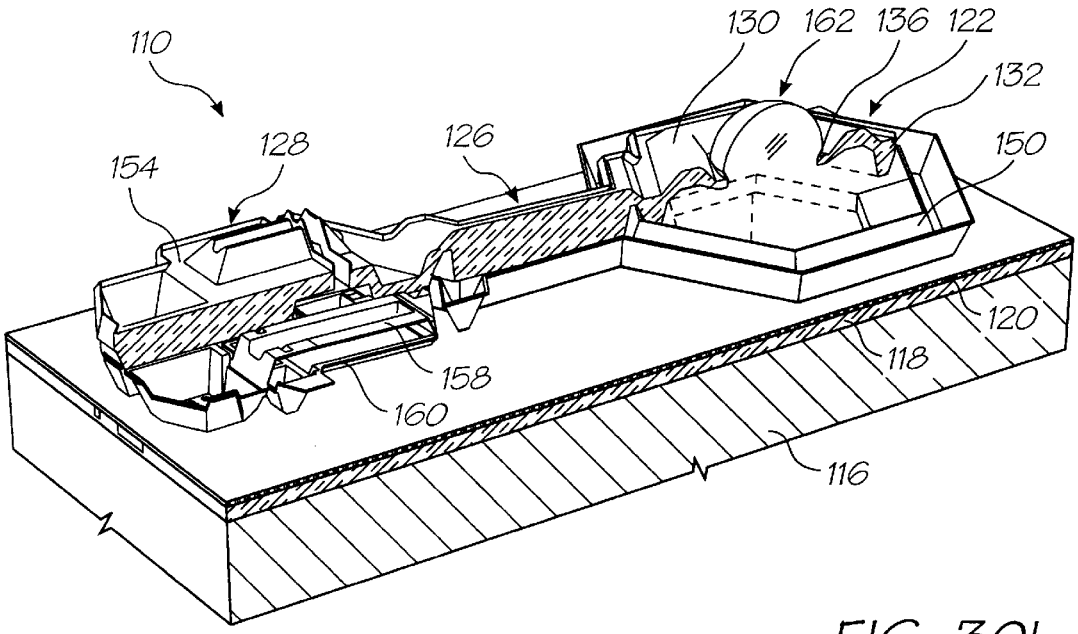
Figure 30C:
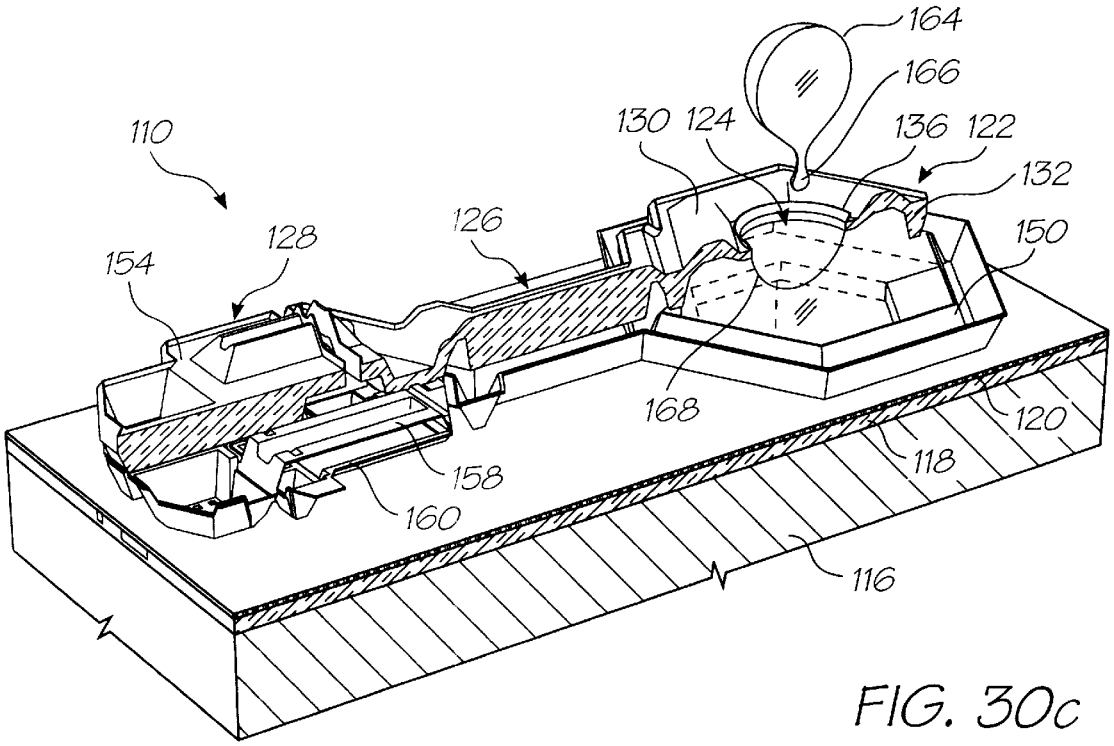

A further UV release tape (not shown) is applied to a rear of the wafer 16 and the tape 240 is removed. The sacrificial layers 208, 212, 220, 228 and 234 are stripped in oxygen plasma to provide the final nozzle assembly 110 as shown in FIGS. 27*r* and 28*r* of the drawings. For ease of reference, the reference numerals illustrated in these two drawings are the same as those in FIG. 20 of the drawings to indicate the relevant parts of the nozzle assembly 110. FIGS. 30 and 31 show the operation of the nozzle assembly 110, manufactured in accordance with the process described above with reference to FIGS. 27 and 28, and these figures correspond to FIGS. 21 to 23 of the drawings.

It would be appreciated by a person skilled in the art that numerous variations and/or modifications may be made to the present invention as shown in the preferred embodiment without departing from the spirit or scope of the invention as broadly described. The present embodiment is, therefore, to be considered in all respects to be illustrative and not restrictive.

The presently disclosed ink jet printing technology is potentially suited to a wide range of printing systems including: color and monochrome office printers, short run digital printers, high speed digital printers, offset press supplemental printers, low cost scanning printers, high speed pagewidth printers, notebook computers with inbuilt pagewidth printers, portable color and monochrome printers, color and monochrome copiers, color and monochrome facsimile machines, combined printer, facsimile and copying machines, label printers, large format plotters, photograph copiers, printers for digital photographic 'minilabs', video printers, PHOTO CD (PHOTO CD is a registered trademark of the Eastman Kodak Company) printers, portable printers for PDAs, wallpaper printers, indoor sign printers, billboard printers, fabric printers, camera printers and fault tolerant commercial printer arrays.

I claim:

1. An ink jet nozzle assembly including a nozzle chamber having a nozzle, the chamber including a movable portion configured for movement to effect ejection of ink from the chamber via said nozzle, the assembly further including an actuator attached to or formed integrally with the movable portion, the actuator having an electrically conductive portion and an electrically resistive portion such that upon passing a current through both said portions, said actuator is caused to deform elastically to effect said movement of said movable portion.

2. An assembly according to claim 1 wherein said electrically conductive portion and said electrically resistive portion are respective surfaces of a thermal actuator arm.

3. An assembly according to claim 1 wherein the movable portion includes the nozzle and wherein the nozzle chamber includes a fixed portion mounted on a substrate.

4. An ink jet nozzle assembly including:

a nozzle chamber having an inlet in fluid communication with an ink reservoir and a nozzle through which ink from the chamber can be ejected;

a chamber including a fixed portion and a movable portion, relative movement between the fixed portion and the movable portion in an ejection phase reducing an effective volume of the chamber, and alternate movement in a refill phase enlarging the effective volume of the chamber; and a thermal actuator to eject ink from said nozzle chamber via said nozzle, said thermal actuator comprising a lower planar surface constructed from a highly electrically conductive material interconnected to an upper planar surface constructed from an electrically resistive material such that upon passing a current between said planar surfaces, said thermal actuator is caused to bend so as to effect movement of said movable portion and cause ink to be ejected through said nozzle.

5. An assembly according to claim 4 wherein the movable portion includes the nozzle and the fixed portion is mounted on a substrate.

6. An assembly according to claim 4 wherein the fixed portion includes the nozzle mounted on a substrate.

7. An assembly according to claim 4 wherein said actuator is attached to a substrate and further includes a stiff paddle portion which increases bending of said actuator near a point where it is attached to the substrate.

8. An assembly as claimed in claim 7 wherein said stiff paddle is formed of silicon nitride.

9. An assembly as claimed in claim 4 wherein said actuator further includes an expansion coating having a high coefficient of thermal expansion on top of said upper planar surface so as to increase bending of said actuator.

10. An assembly as claimed in claim 9 wherein said expansion coating comprises substantially polytetrafluoroethylene.

11. An assembly as claimed in claim 4 wherein between said upper planar surface and said lower planar surface there is provided a gap, formed upon etching away of a deposited sacrificial material.

12. An assembly as claimed in claim 11 wherein said upper planar surface includes a plurality of etchant holes provided so as to allow a more rapid etching of said sacrificial layer during construction.

13. An assembly as claimed in claim 4 wherein said upper planar surface comprises substantially Indium Tin Oxide (IFO).

14. An assembly as claimed in claim 4 wherein said lower planar surface comprises substantially metal.

15. An assembly as claimed in claim 4 wherein said upper and lower surfaces are further coated with a passivation material.

16. An assembly as claimed in claim 4 wherein said nozzle is formed on a silicon wafer using micro-electro mechanical systems construction techniques.

* * * * *